US008303470B2

(12) United States Patent
Stewart et al.

(10) Patent No.: US 8,303,470 B2
(45) Date of Patent: Nov. 6, 2012

(54) EXERCISE APPARATUS WITH FLEXIBLE ELEMENT

(75) Inventors: Jonathan M. Stewart, Seattle, WA (US); David E. Dyer, Renton, WA (US); Peter J. Arnold, Snohomish, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 13/087,292

(22) Filed: Apr. 14, 2011

(65) Prior Publication Data

US 2011/0224048 A1 Sep. 15, 2011

Related U.S. Application Data

(63) Continuation of application No. 12/760,553, filed on Apr. 14, 2010.

(60) Provisional application No. 61/324,733, filed on Apr. 15, 2010, provisional application No. 61/212,609, filed on Apr. 15, 2009.

(51) Int. Cl.
*A63B 22/04* (2006.01)

(52) U.S. Cl. ..... 482/52; 482/51; 482/53

(58) Field of Classification Search ..... 482/51–53, 482/57, 70, 71, 79, 80
See application file for complete search history.

(56) References Cited

U.S. PATENT DOCUMENTS 5,039,088 A * 8/1991 Shifferaw ..... 482/51
5,387,169 A 2/1995 Wang ..... 482/73
5,419,751 A * 5/1995 Byrd et al. ..... 482/138
5,611,756 A * 3/1997 Miller ..... 482/52
5,911,649 A * 6/1999 Miller ..... 482/52
5,967,944 A * 10/1999 Vittone et al. ..... 482/52
6,036,622 A 3/2000 Gordon ..... 482/51
6,045,487 A * 4/2000 Miller ..... 482/52
6,113,518 A * 9/2000 Maresh et al. ..... 482/52
6,152,859 A 11/2000 Stearns ..... 482/52
6,579,210 B1 * 6/2003 Stearns et al. ..... 482/52
7,083,549 B1 8/2006 Fan ..... 482/52
7,137,927 B2 11/2006 Maresh et al. ..... 482/52
7,217,225 B2 * 5/2007 Husted et al. ..... 482/51
7,226,390 B2 * 6/2007 Stearns ..... 482/52
7,479,093 B1 * 1/2009 Immordino et al. ..... 482/52
7,485,072 B2 2/2009 Chuang et al. ..... 482/52
7,507,184 B2 3/2009 Rodgers, Jr. ..... 482/52
7,520,839 B2 4/2009 Rodgers, Jr. ..... 482/52
7,530,926 B2 5/2009 Rodgers, Jr. ..... 482/52
7,601,102 B2 10/2009 Alessandri et al. ..... 482/52
7,632,219 B2 12/2009 Ohrt et al. ..... 482/52
7,641,598 B2 1/2010 Rodgers, Jr. ..... 482/52
7,678,025 B2 3/2010 Rodgers, Jr. ..... 482/52
7,708,668 B2 * 5/2010 Rodgers, Jr. ..... 482/51
7,708,669 B2 5/2010 Rodgers, Jr. ..... 482/52
7,811,208 B2 10/2010 Rodgers, Jr. ..... 482/52
7,828,698 B2 11/2010 Rodgers, Jr. ..... 482/52
7,874,963 B2 1/2011 Grind ..... 482/71
7,878,947 B1 2/2011 Rodgers, Jr. ..... 482/52
7,887,463 B2 * 2/2011 Neuberg et al. ..... 482/51
7,887,465 B2 2/2011 Uffelman ..... 482/52

(Continued)

*Primary Examiner* — Glenn Richman
(74) *Attorney, Agent, or Firm* — Terence P. O'Brien; Todd A. Rathe

(57) ABSTRACT

An exercise device includes a flexible support element and a step height adjustment mechanism. The flexible support element couples at least one crank to a right foot support and a left foot support. The step height adjustment mechanism allows a person to adjust a step height of a path through which the left and right foot supports move.

29 Claims, 27 Drawing Sheets

U.S. PATENT DOCUMENTS

| | | | | |
|---|---|---|---|---|
| 7,922,625 | B2 | 4/2011 | Grind | 482/52 |
| 7,988,600 | B2 | 8/2011 | Rodgers, Jr. | 482/52 |
| 8,021,275 | B2 | 9/2011 | Rodgers, Jr. | 482/52 |
| 8,033,961 | B2 * | 10/2011 | Kuo | 482/52 |
| 8,062,187 | B2 * | 11/2011 | Lull et al. | 482/52 |
| 8,092,348 | B2 * | 1/2012 | Anderson et al. | 482/52 |
| 8,092,351 | B1 * | 1/2012 | Rodgers, Jr. | 482/52 |
| 8,105,213 | B2 * | 1/2012 | Stewart et al. | 482/52 |
| 2001/0011053 | A1 * | 8/2001 | Miller | 482/51 |
| 2005/0043148 | A1 * | 2/2005 | Maresh | 482/70 |
| 2005/0124467 | A1 | 6/2005 | Rodgers, Jr. | 482/52 |
| 2005/0272562 | A1 * | 12/2005 | Alessandri et al. | 482/52 |
| 2006/0217234 | A1 * | 9/2006 | Rodgers, Jr. | 482/52 |
| 2007/0167289 | A1 * | 7/2007 | Alessandri et al. | 482/51 |
| 2007/0219061 | A1 * | 9/2007 | Rodgers, Jr. | 482/52 |
| 2007/0219062 | A1 * | 9/2007 | Rodgers | 482/52 |
| 2007/0219063 | A1 * | 9/2007 | Anderson et al. | 482/52 |
| 2007/0219064 | A1 * | 9/2007 | Anderson et al. | 482/52 |
| 2007/0219065 | A1 * | 9/2007 | Anderson et al. | 482/52 |
| 2007/0298936 | A1 | 12/2007 | Ohrt et al. | 482/52 |
| 2009/0156369 | A1 | 6/2009 | Rodgers, Jr. | 482/52 |
| 2009/0156370 | A1 * | 6/2009 | Rodgers, Jr. | 482/52 |
| 2009/0203501 | A1 * | 8/2009 | Rodgers, Jr. | 482/52 |
| 2010/0022357 | A1 * | 1/2010 | Anderson et al. | 482/52 |
| 2010/0137110 | A1 * | 6/2010 | Rodgers, Jr. | 482/52 |
| 2010/0151999 | A1 * | 6/2010 | Kuo | 482/52 |
| 2010/0173754 | A1 * | 7/2010 | Rodgers, Jr. | 482/52 |
| 2011/0312471 | A1 * | 12/2011 | Anderson et al. | 482/52 |

* cited by examiner

EXERCISE APPARATUS WITH FLEXIBLE ELEMENT

CROSS-REFERENCE TO RELATED PATENT APPLICATIONS

The present application claims priority under 35 U.S.C. 119 from U.S. Provisional Patent Application Ser. No. 61/324,733 filed on Apr. 15, 2010 by Jonathan M. Stewart, David E. Dyer and Peter J. Arnold and entitled EXERCISE APPARATUS WITH FLEXIBLE ELEMENT, the full disclosure of which is hereby incorporated by reference. The present application is a continuation of and claims priority under 35 U.S.C. 120 from co-pending U.S. patent application Ser. No. 12/760,553 filed on Apr. 14, 2010 by Jonathan M. Stewart, David E. Dyer and Peter J. Arnold and entitled EXERCISE APPARATUS WITH FLEXIBLE ELEMENT which claims priority under 35 U.S.C. 119 from U.S. Provisional Patent Application Ser. No. 61/212,609 filed on Apr. 15, 2009, the full disclosures of which are hereby incorporated by reference.

BACKGROUND

Some exercise apparatus allow a person to adjust a horizontal length of his or her stride simply by the person applying force to foot supports of the exercise apparatus. Such exercise apparatus still do not permit the person to also adjust a maximum vertical length or vertical step height. Moreover, such exercise apparatus may be bulky, complex and expensive.

DETAILED DESCRIPTION OF THE EXAMPLE EMBODIMENTS

Figure 1:
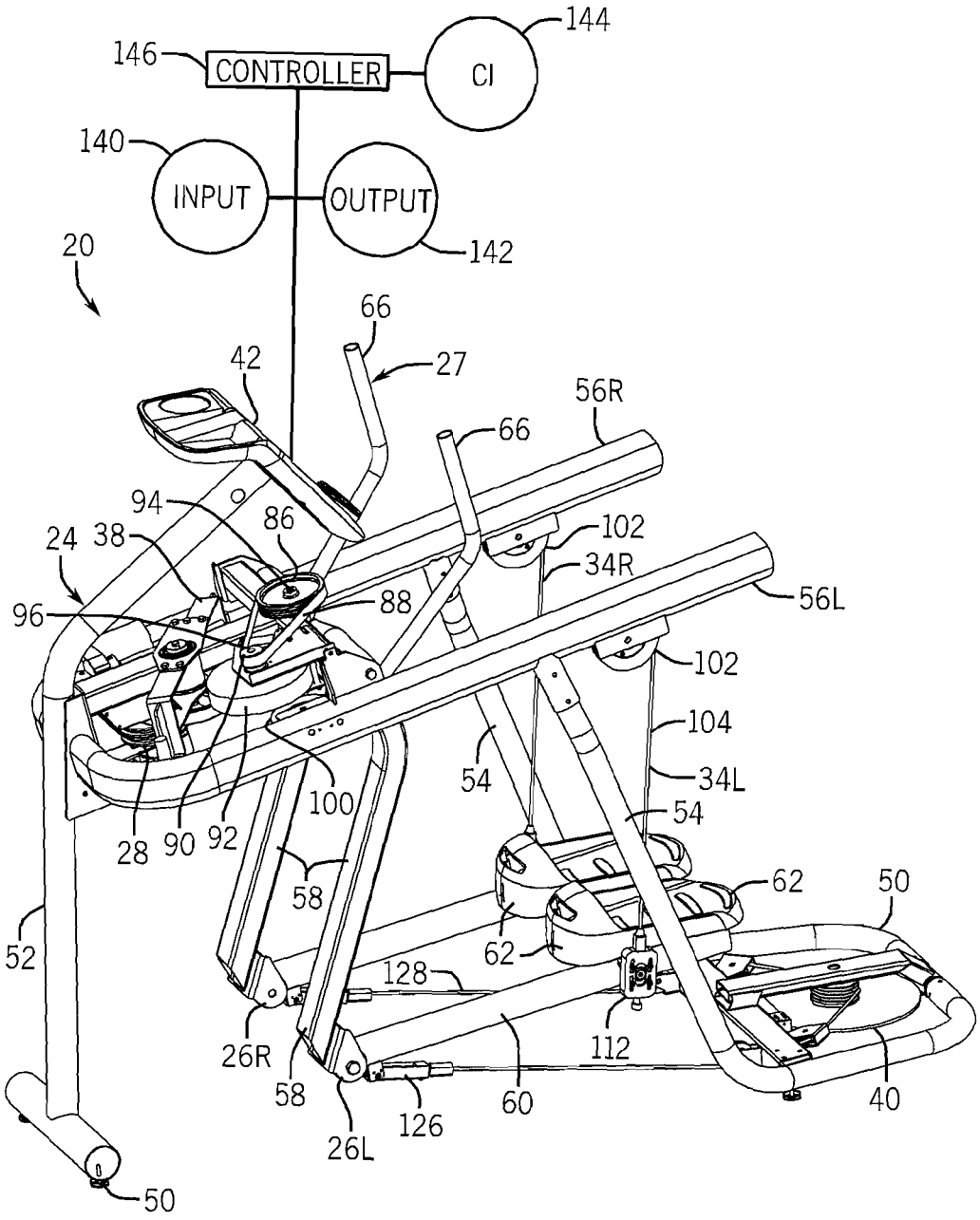
FIG. 1 is a top perspective view of an exercise apparatus according to an example embodiment with portions schematically shown.
Figure 2:
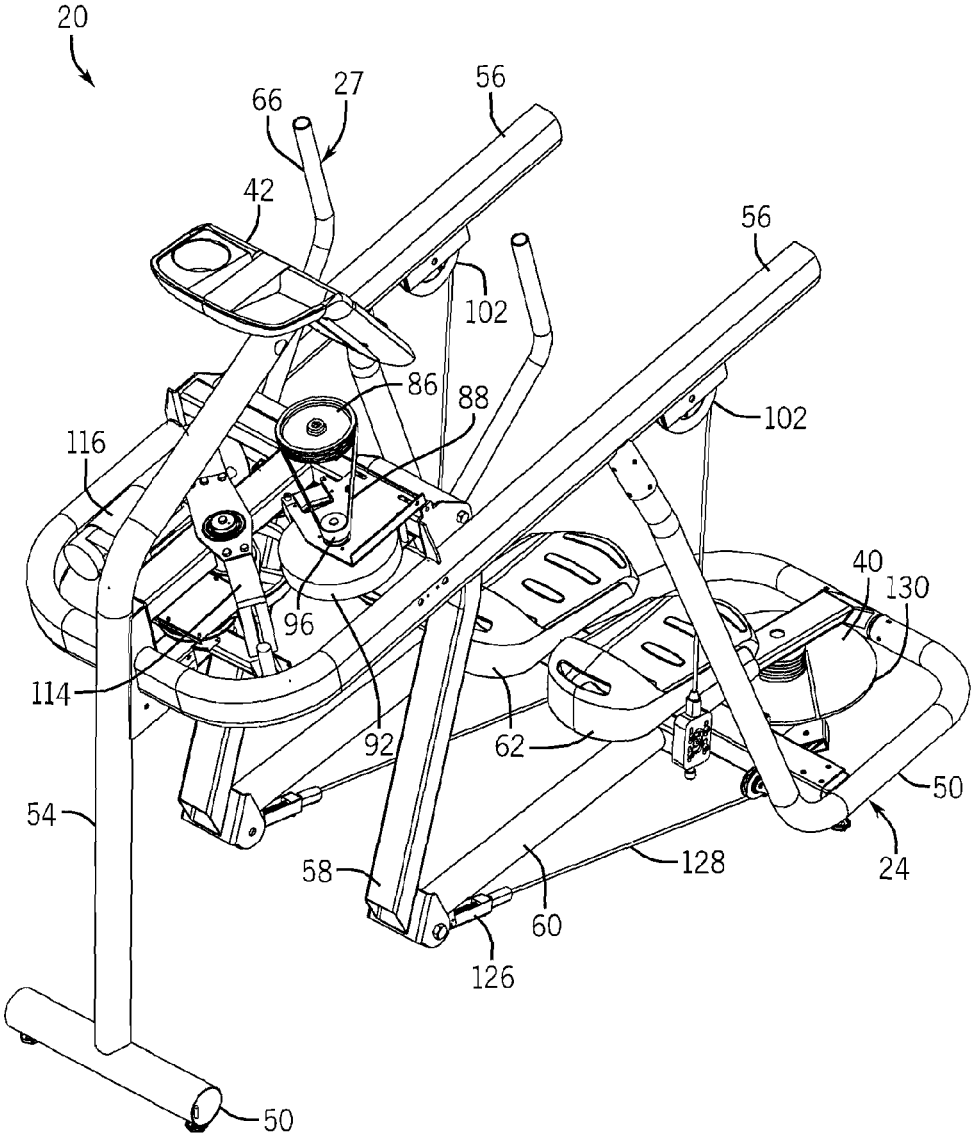
FIG. 2 is another top perspective view of the exercise apparatus of FIG. 1.
Figure 3:
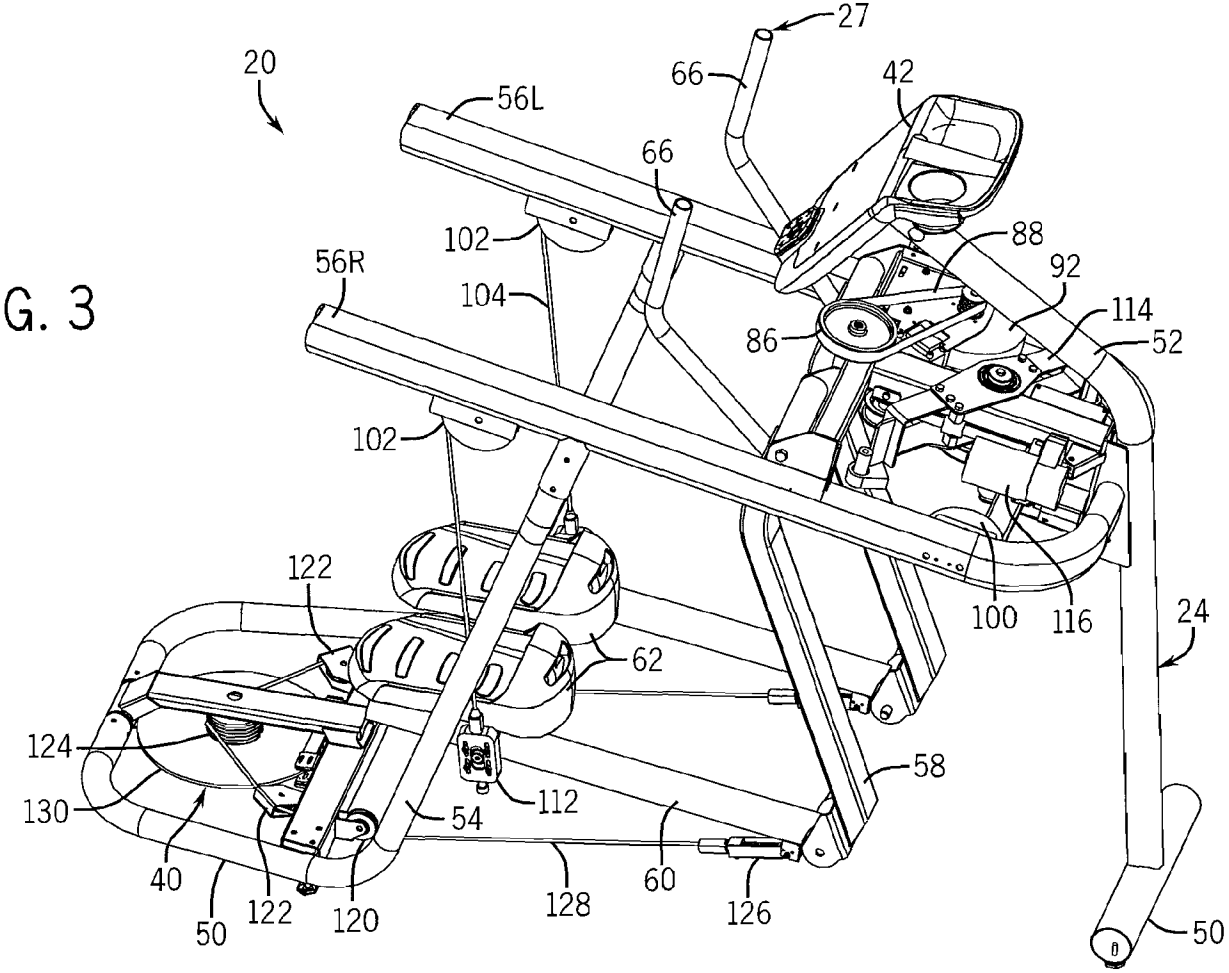
FIG. 3 is another perspective view of the exercise apparatus of FIG. 1.
Figure 4:
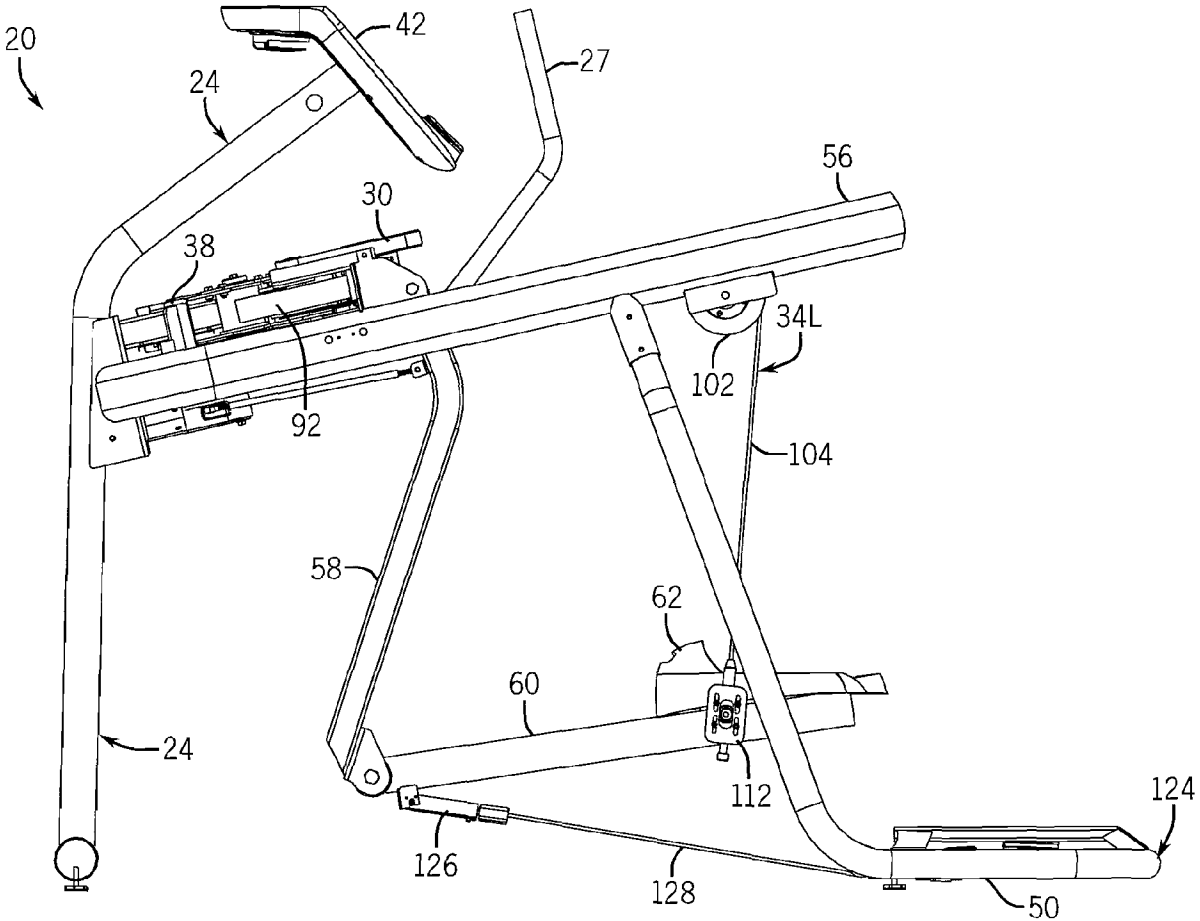
FIG. 4 is a left side elevational view of the exercise apparatus of FIG. 1.
Figure 5:
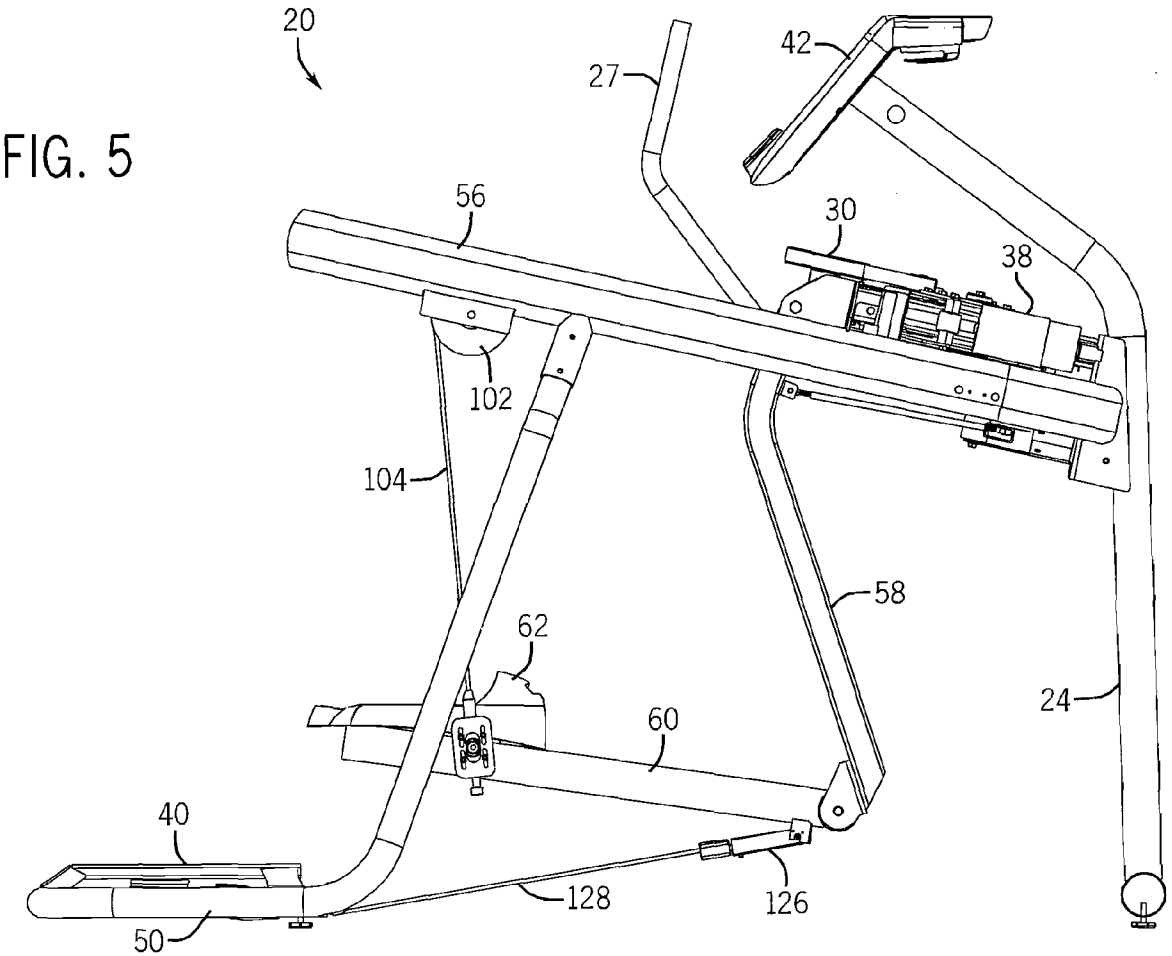
FIG. 5 is a right side elevational view of the exercise apparatus of FIG. 1.
Figure 6:
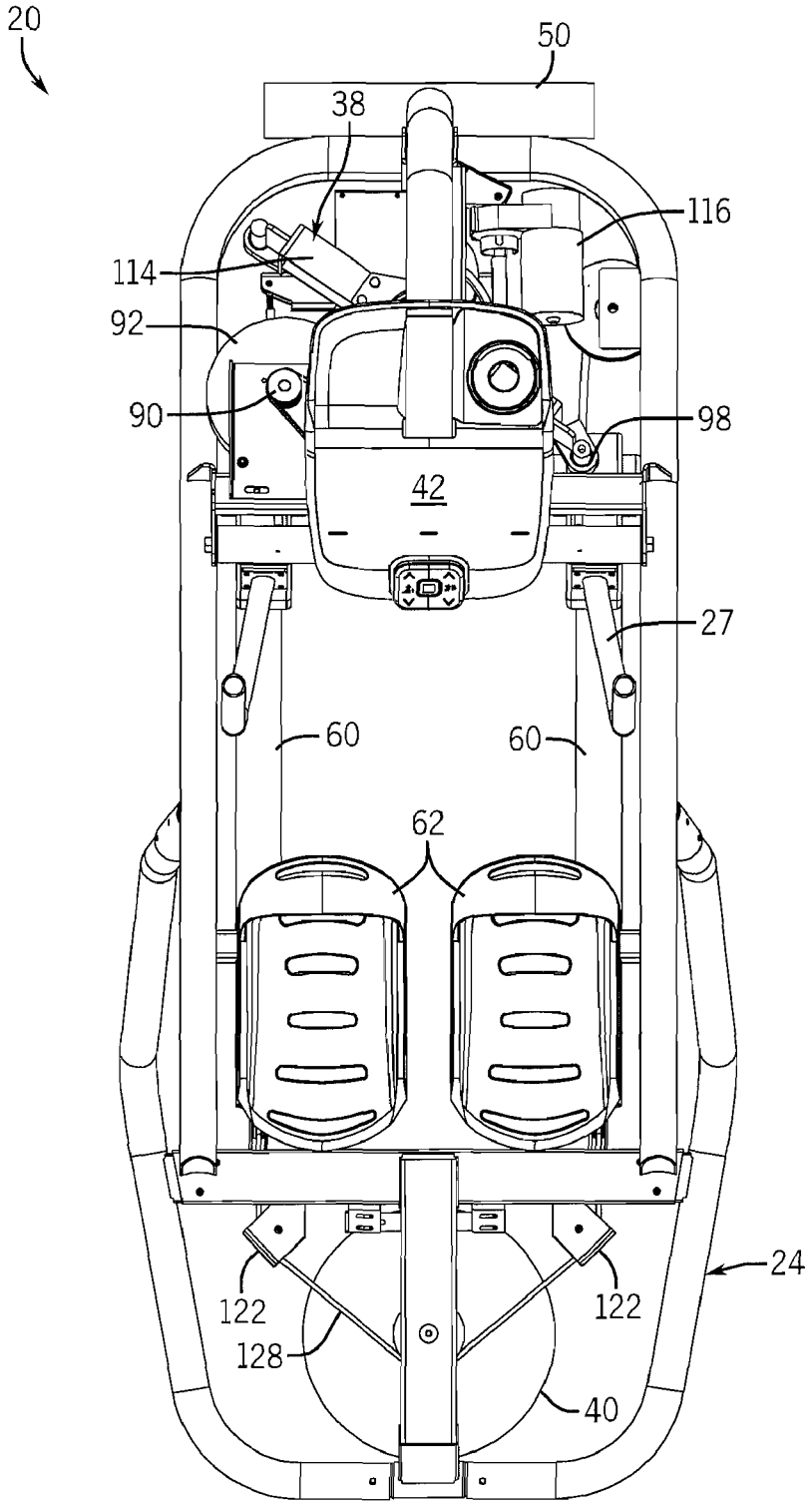
FIG. 6 is a top plan view of the exercise apparatus of FIG. 1.
Figure 7:
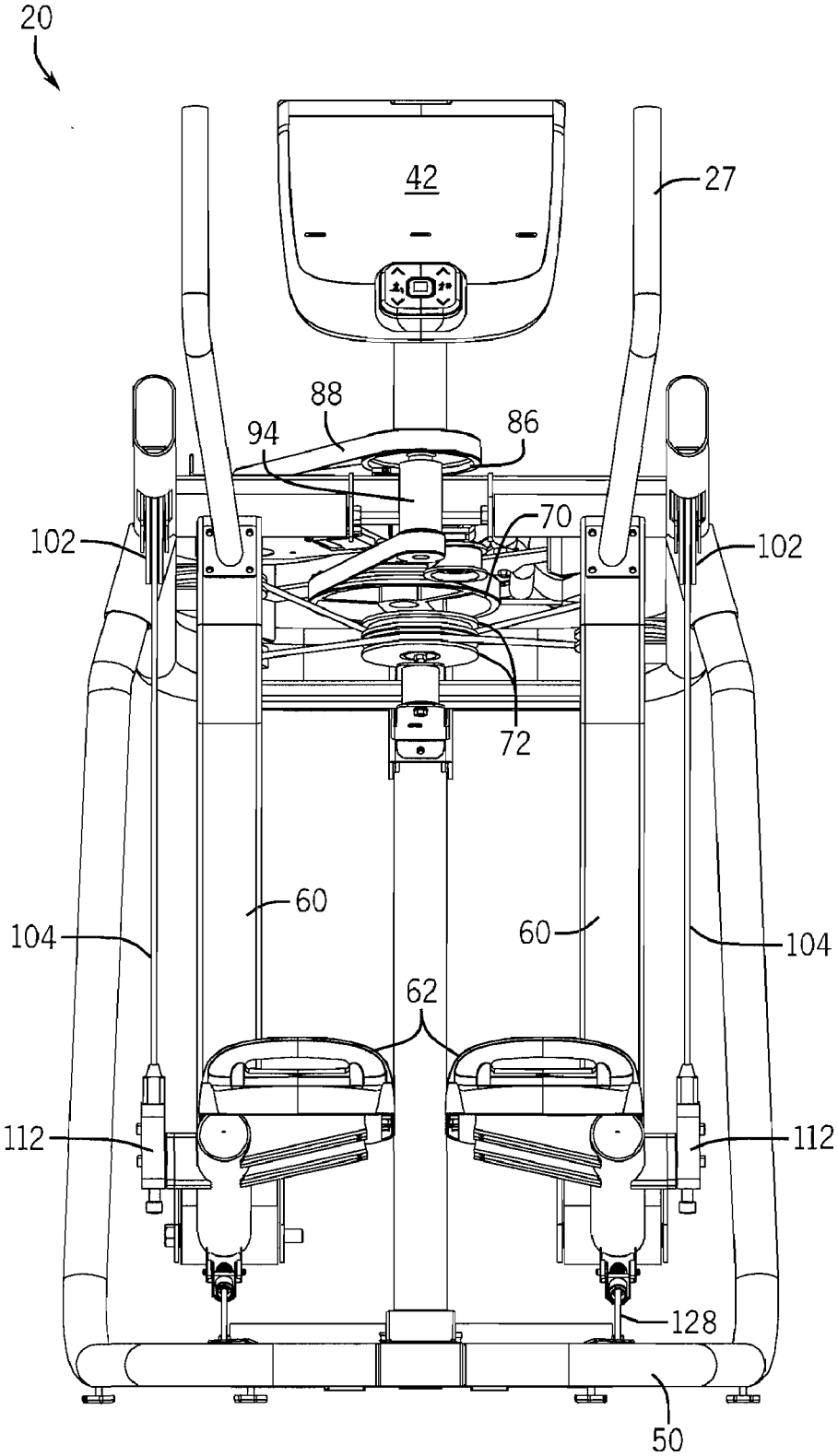
FIG. 7 is a rear elevational view of the exercise apparatus of FIG. 1.

FIGS. 1-8 illustrate exercise device or apparatus 20 according to an example embodiment. Exercise device or apparatus 20 allows a person to adjust a horizontal length of his or her stride simply by the person applying force to foot supports of the exercise apparatus. Exercise apparatus 20 further allows the person to also adjust a vertical length or vertical step height. Exercise apparatus 20 provides such freedom of motion using flexible elements 104 in an architecture that is compact, less complex and less expensive. As shown by FIGS. 1-7, exercise apparatus 20 comprises frame 24, linkage assemblies 26L, 26R (collectively referred to as linkage assemblies 26), swing arms 27, crank system 28, resistance system 30, coupling systems 34L, 34R, step height adjustment mechanism 38, horizontal resistance system 40 and display 42.

Frame 24 supports exercise apparatus 20 upon a base or floor. Frame 24 includes base portions 50, front or forward post or leg 52, rear supports, legs or legs 54 and side arms 56L, 56R (collectively referred to as side arms 56). Base portions 50 bear against the floor and are connected to legs 52, 54. Forward leg 52 extends at a forward end of exercise apparatus 20 and is connected to both of side arms 56 while supporting display 42. Legs 54 extend at a rear end of exercise apparatus 20 and are connected to side arms 56.

Side arms 56 extend rearwardly from leg 52 on opposite sides of both linkage assemblies 26. Side arms 56 extend substantially parallel to one another at the same vertical height. Side arms 56 provide bars, beams or shafts by which a person's left and right hands may grasp or rest upon when mounting exercise apparatus 20 or when otherwise not grasping handle portions of linkage assemblies 26. Side arms 56 help retain a person on linkage assemblies 26 and on exercise apparatus 20 and reduce the likelihood of a person falling off of exercise apparatus 20.

In the example illustrated, side arms 56 further serve as shields about flexible elements of coupling systems 34. In the example illustrated, side arms 56 also assist in supporting crank system 28, step height adjustment mechanism 38 and portions of coupling systems 34. In other embodiments, separate structures independent of side arm 56 may be used to support crank system 28, step height adjustment mechanism 38 and portions of coupling systems 34.

In other embodiments, frame 24 may have a variety of other configurations. For example, in other embodiments, side arms 56 may alternatively not enclose flexible elements. In other embodiments, side arms 56 may not interconnect legs 52 and 54. Base portions 50 may also have different configurations.

Linkage assemblies 26 comprise one or more members movably supported by frame 24 and configured to elevate and support a person's feet as the person exercising applies force to such linkage assemblies to move such linkage assemblies relative to frame 24. In the example illustrated, each of linkage assemblies 26 includes arcuate motion member 58, foot support member 60 and foot pad 62. Each arcuate motion member 58 is pivotally supported by one of side arms 56 at one end portion and is pivotally connected to foot support member 60 at another end portion.

Each foot support member 60 (also known as a stair arm) extends from arcuate motion member 58 and supports one of foot pads 62. Each foot pad 62 comprises a paddle, pedal, or the like providing a surface upon which a person's foot may rest. In the example illustrated, each foot pad 62 further includes a toe cover or toe clip against which a person's foot or toes may apply force in an upward or vertical direction. Foot pads 62 may have a variety of different sizes, shapes and configurations. In other embodiments, each arcuate motion member 58 and foot support member 60 (sometimes referred to as a foot link) may also have different configurations, shapes and connections. For example, in other embodiments, a lieu of foot support member 60 having a rear end which is cantilevered, foot support member 60 may alternatively have a rear end which is pivotally supported by another supporting linkage extending from one of side arms 56 or another portion of frame 24.

Figure 8:
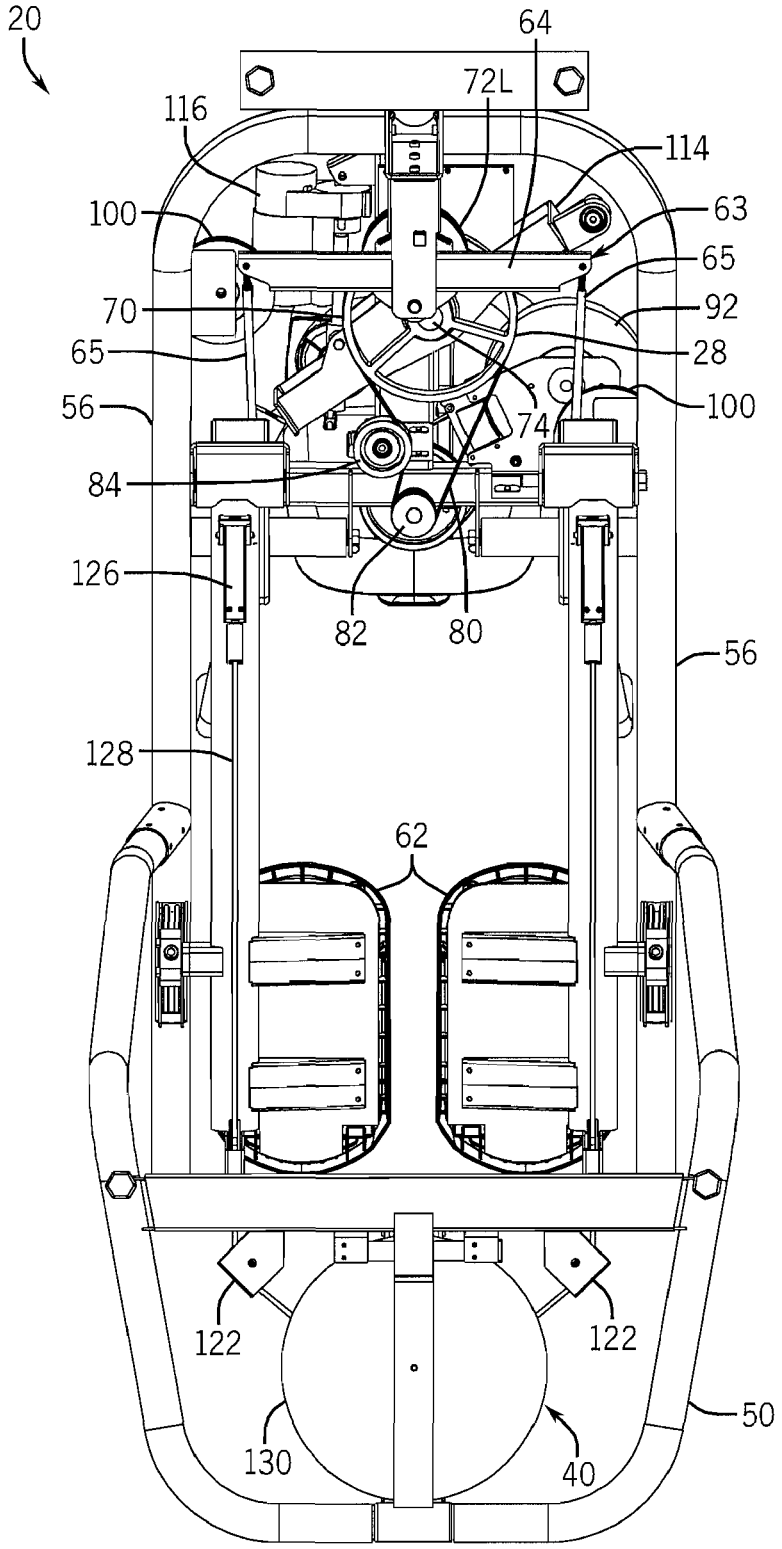
FIG. 8 is a bottom plan view of the exercise apparatus of FIG. 1.

In the example illustrated, linkage assemblies 26L and 26R are linked to one another by a rigid synchronizer 63 including rocker arm 64 and links 65 (shown in FIG. 8). Rocker arm 64 is pivotally supported by frame 50. Each of links 65 have a first end pivotally coupled to rocker arm 64 and a second end pivotally coupled to one of members 58. Synchronizer 63 synchronizes pivoting movement of linkage assemblies 26 such that linkage assemblies 26 move 180 degrees out of phase with respect to one another. In other embodiments, other synchronization mechanisms may be used. In some embodiments, synchronizer 63 may be omitted.

Swing arms 27 comprise arms having handle portions 66 configured to be grasped by a person while linkage assemblies 26 are pivoted relative to frame 24. In the example illustrated, swing arms 66 are rigidly connected to or integrally formed as a single unitary body with arcuate motion members 58 so as to pivot with arcuate motion members 58. As a result, swing arms 27 permit a person to exercise his or her arms and upper body. In other embodiments, swing arms 27 may pivot independent of linkage assemblies 58, may have independent resistance systems for exercising the upper body or may be rigidly or stationarily supported by frame 24. In some embodiments, swing arms 66 may be omitted.

Crank system 28 comprises a mechanism configured to synchronize movement of linkage assemblies 26 and to apply a resistance to such movement. FIGS. 8-11 illustrate crank system 28 in more detail. As shown by such figures, crank system 28 includes crank arm 70, and flexible element crank guides 72L, 72R (collectively referred to as flexible element crank guides 72). Crank arm 70 comprises a member configured to rotate about a substantially vertical axis 74 and to be coupled to a flexible element 104 of one of coupling systems 34 at a location radially spaced from axis 74. Because crank arm 70 rotates about a substantially vertical axis 74, crank system 28 is more compact. For example, crank system 28 may be at least partially contained within or least partially overlap in a vertical direction the vertical thickness of side arms 56 of frame 50. In yet other embodiments, crank system 28 may include a crank arm 70 that rotates about a horizontal axis.

In the example illustrated, crank arm 70 comprises a combined input crank and sheave in the form of a disk, wheel or the like, wherein the disc or wheel concentrically extends about axis 74 and is coupled to the flexible element at a location radially spaced from axis 74. In other embodiments, crank arm 70 may comprise one or more members configured to rotate about axis 74 and to be coupled to a flexible element 104 of one of coupling systems 34, wherein crank arm 70 does not concentrically extend about axis 74.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Figure 11:
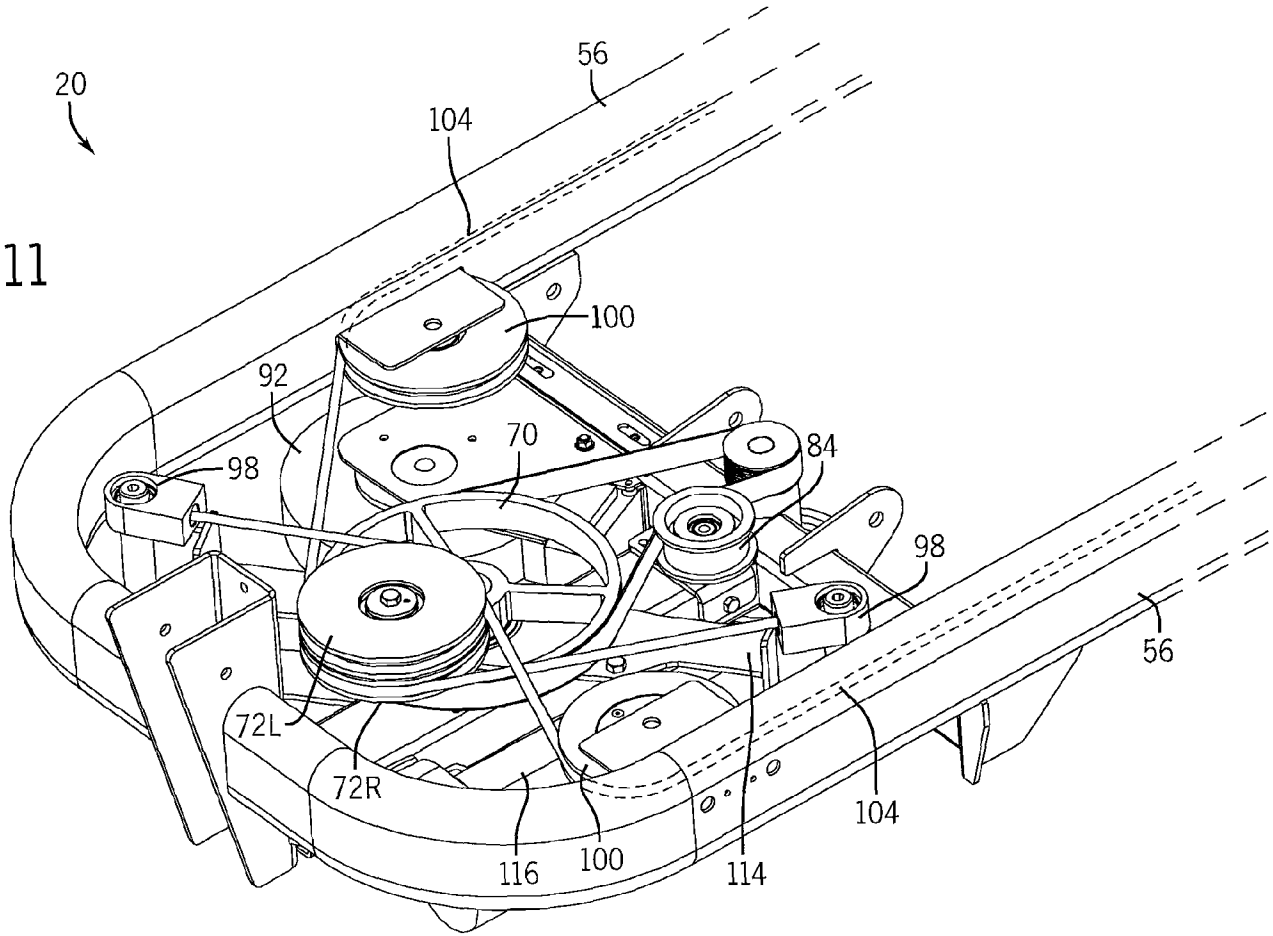
FIG. 11 is a fragmentary top perspective view of the exercise apparatus of FIG. 1 illustrating a step height adjustment mechanism according to an example embodiment.

Flexible element crank guides 72 comprise members that are connected to crank arm 70 and carried by crank arm 70 so as to rotate about axis 74 and about which flexible elements 104 of coupling system 34 wrap so as to transmit force to crank guides 72 and ultimately to crank arm 70 of crank system 28. In the example illustrated, flexible element crank guides 72 are pivotally or rotationally coupled to crank arm 70 so as to rotate about or pivot about axis 76 which is radially spaced from axis 74. As shown by FIG. 11, flexible element crank guides 72 are vertically stacked upon one another so as to rotate about a single common axis 76, wherein flexible elements 104 of coupling system 34 wrap about opposite sides of guides 72. Because flexible element crank guides 72 share a single crank pin or rotational axis 76, because guides 72 are stacked with the flexible elements wrapping about opposite sides of such guides 72, crank system 28 is more compact.

In the example illustrated, each flexible element crank guides 72 comprises a pulley. In other embodiments, each flexible element crank guide 72 may alternatively comprise a spool or disc against which a flexible element moves or slides without rotation of the flexible element crank guide 72. In yet other embodiments, crank system 28 may alternatively include two crank arms 70 and two guides 72, wherein each linkage assembly 26 is provided with its own discrete and dedicated crank arm 70 and flexible element crank guide 72.

Resistance system 30 applies additional resistance to the rotation of crank system 28. In the particular example illustrated, resistance system 30 provides a selectively adjustable incremental resistance to the rotation of crank arm 70 of crank system 28. FIGS. 1 and 8 illustrate resistance system 30 in more detail. As shown by FIGS. 1 and 8, resistance system 30 includes belt 80, pulley 82, tensioner 84, pulley 86, belt 88, pulley 90 and resistance source 92. As shown by FIG. 8, belt 80 wraps about crank arm 70 and pulley 82. Tensioner 82 comprises a member, such as a pulley, which is movably positioned or adjustable relative to belt 80 so as to bear against belt 80 to adjust the tension of belt 80. As shown by FIG. 1, pulley 82 is connected to pulley 86 by an intervening shaft 94. Belt 88 wraps about pulley 86 and pulley 90. Pulley 90 is connected to resistance source 92 by an intervening shaft 96.

Resistance source 92 comprises a mechanism configured to rotate against a selectively adjustable resistance. In one embodiment, resistance source 92 comprises a metal plate and one or more magnets forming an Eddy brake. In one embodiment, the one or more magnets comprise electromagnets, allowing the strength of the magnetic force to be selectively adjusted to control and vary the resistance applied against the rotation of crank arm 70. In another embodiment, resistance source 92 may comprise an electric generator. In still another embodiment, resistance source 92 may comprise two surfaces in frictional contact with one another to apply a frictional resistance against rotation of crank arm 70. In another embodiment, air brakes may be utilized. In still other embodiments, other brakes or resistance mechanisms may be utilized.

Because resistance system 30 utilizes a two-stage transmission between crank arm 70 and resistance source 92, the arrangement or architecture of crank system 28 and resistance system 30 is more compact and the speed ratio between crank arm 70 and resistance source 92 (approximately 12:1) provides improved electric performance. In other embodiments, a single stage or a transmission with greater than two stages may be employed. In yet other embodiments, resistance system 30 may have other configurations or may be omitted. For example, in another embodiment, a lieu of belt and pulleys, the transmission of resistance system 30 may include gear trains, chains and sprockets or the like.

Coupling system 34 operably couples or joins crank system 28 to foot support members 60 or footpads 62. Each of coupling systems 34 includes front flexible end mount 98, a rear guide element 102 and flexible element 104. As shown by FIG. 11, front flexible end mount 98 (also known as a "dead end") comprises a mount or securement point at which an end of flexible element 104 is attached. In the example illustrated, each mount 98 comprises a swinging or pivoting bearing which allows flexible element 104 to swing from side to side. In the example illustrated, end mount 98 for each of coupling systems 34L and 34R is provided by step height adjustment mechanism 38. In other embodiments in which step height adjustment mechanism 38 is omitted, end mount 98 may be provided by part of frame 24. In still other embodiments in which the ends of flexible elements 104 are directly attached to crank arm 70 and do not wrap about a guide 72, end mounts 98 may be provided on crank arm 70.

Figure 9:
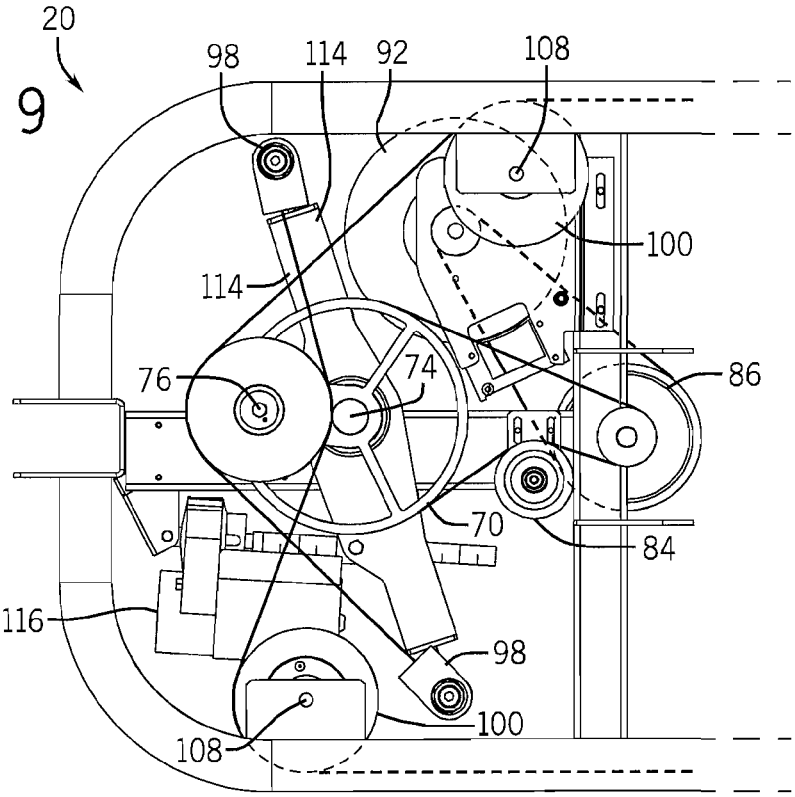
FIG. 9 is a fragmentary top plan view illustrating the exercise apparatus of FIG. 1 at a first step height setting.
Figure 10:
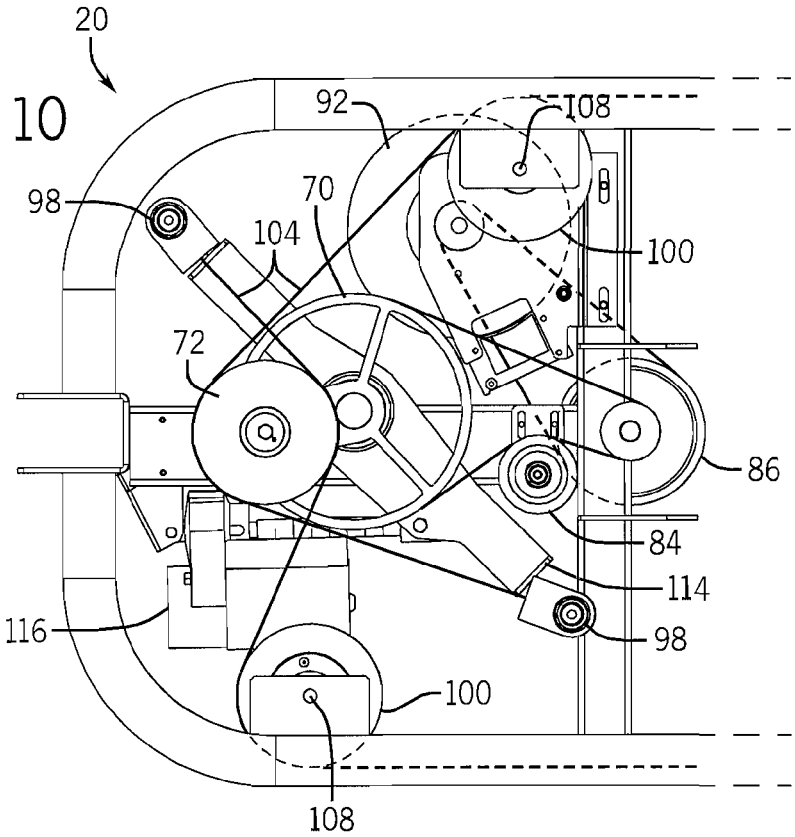
FIG. 10 is a fragmentary top plan view illustrating the exercise apparatus of FIG. 1 at a second step height setting.

Front guide element 100 of each of coupling systems 34 comprises a member configured to direct or guide movement of flexible element 104 as it extends from crank system 28 towards foot support members 60. In the example illustrated, each front guide element 100 comprises a pulley rotationally supported by frame 24 about a substantially vertical axis 108. In other embodiments, each guide element 100 may alternatively comprise a low friction surface which does not rotate and against which flexible element 104 moves or slides. As shown by FIGS. 9 and 10, guide elements 100 of coupling systems 34L and 34R are offset from one another in a forward-rearward direction (a longitudinal direction of exercise apparatus 20). This offsetting of guide elements 100 and their rotational axes 108 facilitates wrapping of flexible elements 104 about opposite sides of flexible element crank guides 72 of crank system 28. In other embodiments in which flexible elements 104 do not wrap about opposite sides of a pair of stacked crank guides 72, guide elements 100 and their rotational axes 108 may not be offset. In embodiments where crank arm 70 or crank guides 72 do not rotate about a substantially vertical axis, guide elements 100 may alternatively rotate about non-vertical axes.

Figure 12:
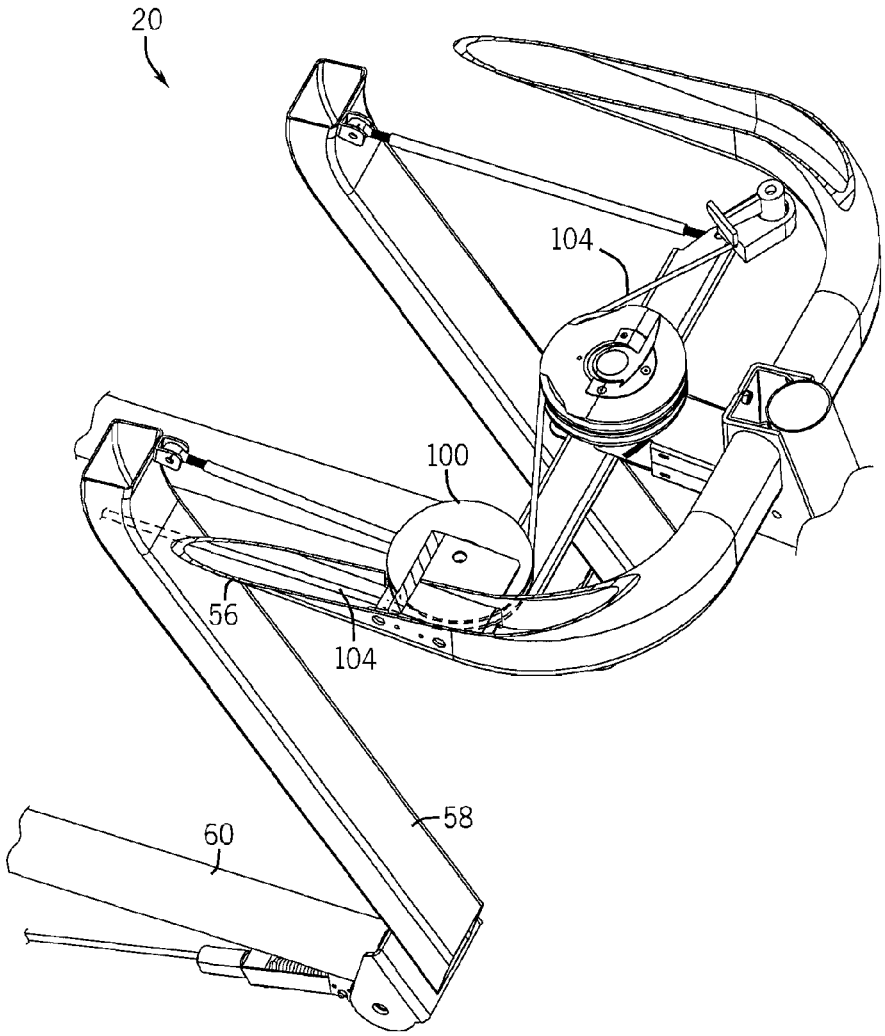
FIG. 12 is a fragmentary sectional view of the exercise apparatus of FIG. 1 illustrating a flexible element path according to an example embodiment.

As shown by FIG. 12, each of guide elements 100 further guides and directs flexible element 104 through an opening into an interior of side arm 56. As a result, each side arm 56 serves a shield as well as a guide for flexible element 104. In other embodiments, each flexible element 104 may alternatively extend on an exterior of side arm 56.

Rear guide elements 102 guide and direct movement of flexible elements 104 from front guide elements 100 to foot support members 60. In the example illustrated, rear guide elements 102 comprises pulleys rotationally supported by side arms 56 of frame 24 proximate to a rear end of exercise apparatus 20 substantially vertically above footpads 62 when footpads 62 are longitudinally aligned. In other embodiments, each of rear guide elements 102 may alternatively comprise a low friction surface which does not rotate and against which flexible element 104 moves or slides.

Figure 13:
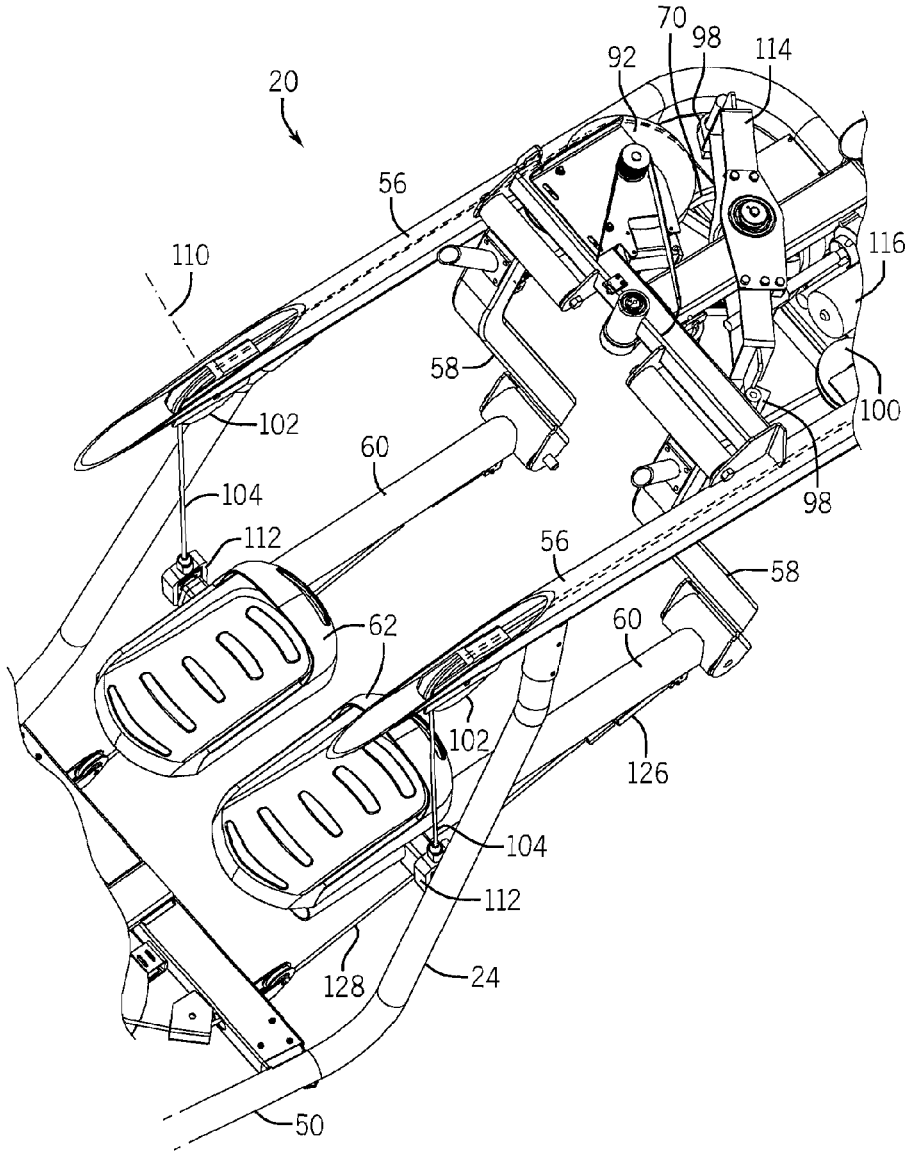
FIG. 13 is another fragmentary sectional view of the exercise apparatus of FIG. 1 further illustrating the flexible element path.
Figure 14:
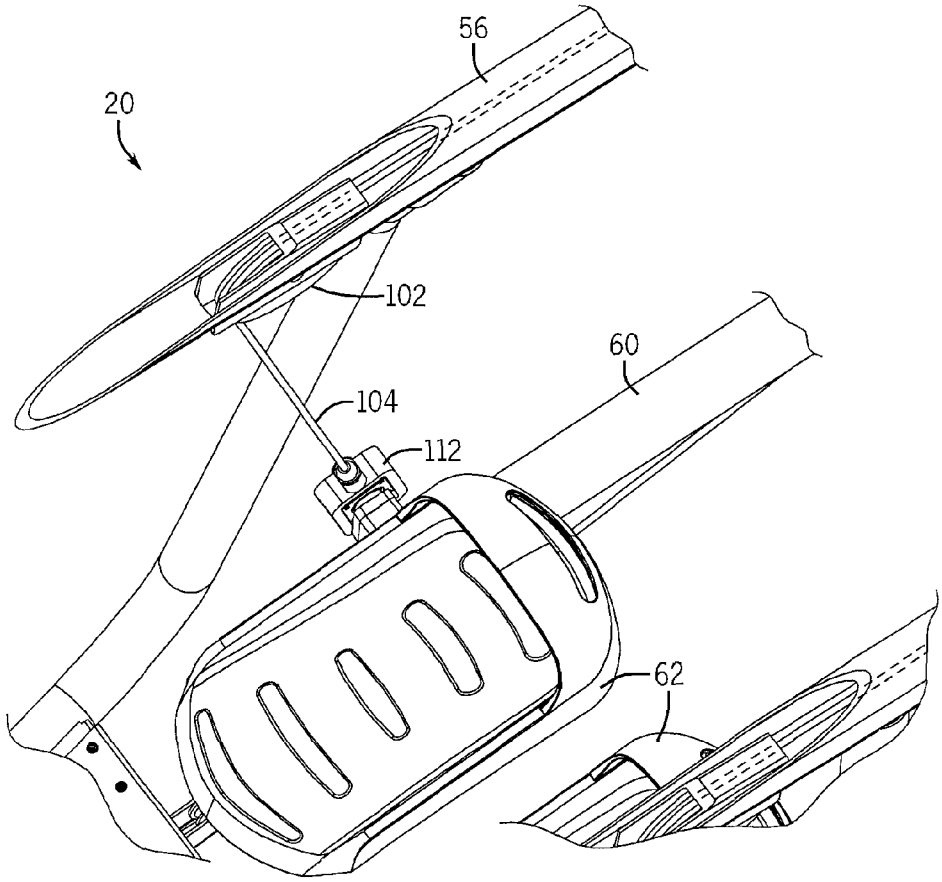
FIG. 14 is another fragmentary sectional view of the exercise apparatus of FIG. 1 illustrating the flexible element path according to an example embodiment.

As shown by FIGS. 13 and 14, each of guide elements 102 further guides and directs flexible element 104 through an opening from an interior of side arm 56 in a substantially vertical direction down to foot support members 60 and footpads 62. In the example illustrated, guide elements 102 rotates about a substantially horizontal axis 110 which is angularly spaced from the axis 108 by 90 degrees. As a result, guide elements 100, 102 cooperate to reorient flexible element 104 from a substantially horizontal orientation at crank system 28 to a substantial vertical orientation when it is attached to foot support members 60 or footpads 62. This change in orientation facilitates the rotation of crank system 28 about a substantially vertical axis. In other embodiments, guide elements 100, 102 may alternatively rotate about parallel axes. Although coupling systems 34 are illustrated as having two guide elements 100, 102, in other embodiments, coupling systems 34 may alternatively include a greater or fewer of such guide elements.

Flexible elements 104 comprise elongated flexible or bendable members such as cables, wires, ropes, belts, cords, strings, straps, chains and the like having a first end mounted or secured to one of mounts 98 and a second opposite end secured to an associated foot support member 60 or footpad 62. In the example illustrated, each flexible element 104 has an end clamped to foot support members 60 by a mount 112 at a location transversely opposite to footpad 62 near or proximate to a forward end of footpad 62. In the example illustrated, each mount 112 includes a body that slides (via screw adjustment) up and down relative to a pivoting block attached to the associated member 60, wherein flexible element 104 is fixed or secured to the body of the mount. Each mount 112 allows the location of members 60 to be adjusted so as to be level with one another. In other embodiments, mounts 112 may comprise other securement mechanisms such as clamps, fasteners and the like.

Each flexible element 104 extends from mount 112 in a substantially vertical direction until engaging rear guide 102. Flexible element 104 wraps partially about rear guide 102 into an interior of one of side arm 56. Flexible element 104 extends through the interior of side arm 56 until engaging front guide element 100. Flexible element 104 wraps partially about front guide element 100 and exits side arm 56. As shown by FIGS. 9 and 10, each flexible element 104 extends from front guide element 100 and wraps about a side of an associated one of crank guides 72. Finally, each flexible element has an end secured to one of end mounts 98.

Because each of coupling systems 34 employs a flexible element 104 (in contrast to a rigid inflexible member or element), forces may be more smoothly transmitted across convoluted paths, allowing coupling systems 34 and crank system 28 to be more compactly arranged and to be less complex and expensive. In addition, flexible elements 104 also have a reduced diameter as compared to rigid elements which permits the transmission of forces from linkage assemblies 26 to crank system 28 in even a more compact fashion. In other embodiments, at least segments or portions of flexible elements 104 may alternatively be replaced with rigid inflexible members or elements.

Step height adjustment mechanism 38 is configured to provide foot support members 60 and foot pads 62 with a multitude of different user selectable maximum upper and lower vertical ranges of motion. Adjustment mechanism 38 allows a person to adjust a maximum step height or a maximum step depth of a path through which the left and right foot supports 60 may move. As shown by FIGS. 9 and 10, adjustment mechanism 38 comprises adjustment member 114 and actuator 116. Adjustment member 114 comprises an arm having opposite end portions providing end mounts 98. In the example illustrated, adjustment member 114 also rotates about axis 74, increasing compactness. In other embodiments, member 114 may rotate about different axes. In yet other embodiments, end mounts 98 may be supported so as to be movable independent of one another to different locations—either by being rotated or by being translated.

Figure 10A:
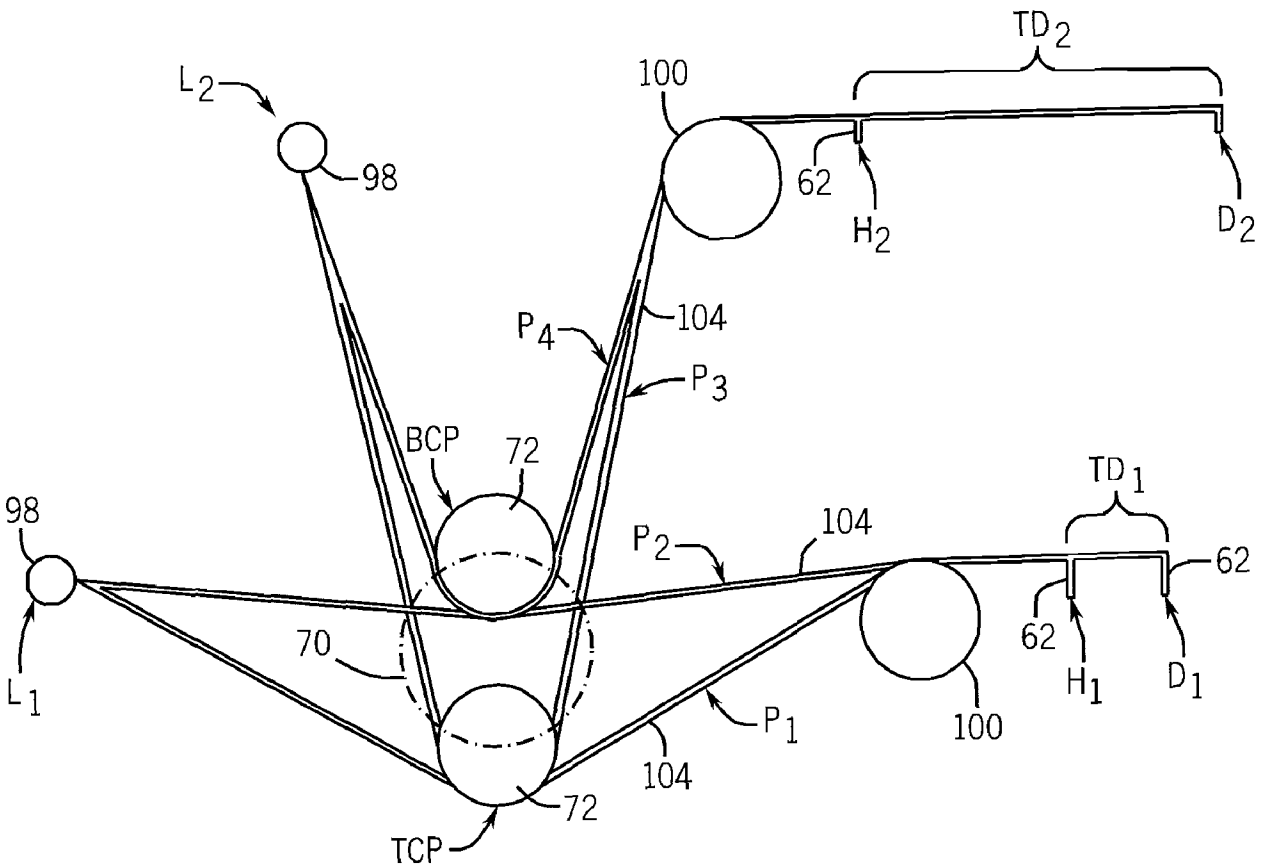
FIG. 10A is a diagram illustrating a flexible element of the exercise apparatus of FIG. 1 at different step height settings.

Actuator 116 comprises a mechanism configured to rotate or move the adjustment member 114 between a plurality of different positions so as to position and retain end mounts 98 at different positions with respect to frame 24, crank arm 70 and crank guides 72. As shown by FIGS. 9, 10 and 10A, repositioning end mounts 98 varies an amount or extent by which the associated flexible element 104 wraps about the associated crank guide 72. This change in the amount of wrap changes the travel distance or travel range of foot supports 62. In one embodiment, the maximum step height, maximum step depth or both maximum step height and depth of the path through which footpads 62 may be adjusted.

FIG. 10A diagrammatically illustrates the adjustment of travel distance achieved by the repositioning of end mounts 98. In particular, FIG. 10A partially superimposes two states of crank 70, one of crank guides 72, one of flexible element guides 100, one of flexible elements 104 and one of end mounts 98, wherein the end mount 98 is positioned or located at a first location L1 and then repositioned to a second position L2. FIG. 10A further illustrates flexible element 104 when end mount 90 is at each of locations L1 and L2 and when crank guide 72 is rotated by crank 70 between a top crank position TCP and a bottom crank position BCP to illustrate the travel distances or ranges which depend upon the positioning of end mount 98.

As shown by FIG. 10A, when end mount 98 is at location L1 and crank guide 72 is at the top crank position TCP, flexible element 104 extends along a path P1, foot pad 62 (schematically shown) has a first maximum height H1. While end mount 98 remains at location L1, crank 70 rotates so as to reposition crank guide 72 at the bottom crank position BCP. As a result, flexible element 104 assumes or extends through a second path P2 which results in foot pad 62 being lowered to a first maximum depth D1. During rotation of crank 70, flexible element 104 extends along a path somewhere between paths P1 and P1. During rotation of crank 70, foot pad 62 correspondingly moves between the first maximum height position H1 and the first maximum depth position D1. In the example illustrated, the other foot pad 62 and flexible element 104 move through similar paths, wherein such movement is 180° out of phase with respect to the movement of the foot pad 62 shown in FIG. 10A. When end mount 98 is at location L1, foot pad 62 has a travel distance TD1.

FIG. 10A further illustrates end mount 98 repositioned or relocated to a second location L2. When end mount 98 is at location L2 and crank guide 72 is at the top crank position TCP, flexible element 104 extends along a path P3, foot pad 62 (schematically shown) has a second maximum height H2. While end mount 98 remains at location L2, crank 70 rotates so as to reposition crank guide 72 at the bottom crank position BCP. As a result, flexible element 104 assumes or extends through a fourth path P4 which results in foot pad 62 being lowered to a second maximum depth D2. During rotation of crank 70, flexible element 104 extends along a path somewhere between paths P1 and P2. During rotation of crank 70, foot pad 62 correspondingly moves between the second maximum height position H2 and the second maximum depth position D2. In the example illustrated, the other foot pad 62 and flexible element 104 move through similar paths, wherein such movement is 180° out of phase with respect to the movement of the foot pad 62 shown in FIG. 10A. When end mount 98 is at location L2, foot pad 62 has a travel distance TD2.

Thus, as shown by FIG. 10A, repositioning of end mounts 98 increases the wrap angle of flexible element 104. Increasing the wrap angle increases the mechanical advantage of the user on the crank. Conversely, decreasing the wrap angle reduces the mechanical advantage of the user on the crank. By adjusting the position of end mount 98, the maximum height and/or the maximum depth to which foot pad 62 may be raised or lowered may be adjusted. Likewise, the total range or total travel distance through which foot pad 62 is moved may also be adjusted. In the example shown, repositioning end mount 98 from location L1 to location L2 results in foot pad 62 being movable through a larger range or travel distance TD2, to a larger maximum height H2 and to a larger or deeper maximum depth D2.

FIGS. 9 and 10 illustrate the simultaneous or concurrent repositioning of both end mounts 98. FIG. 10 illustrates adjustment member 114 rotated in a counter-clockwise direction from the position shown in FIG. 9 (similar to when end mount 98 is moved from location L1 to L2 in the FIG. 10A). As a result, flexible elements 104 of coupling systems 34L and 34R have a greater wrap about crank guides 72. This increased wrap shown in FIG. 10 results in a higher step height, a lower or deeper step depth and a larger travel distance or range for each of foot supports 62. Conversely, rotation of adjustment member 114 in a clockwise direction from the position shown in FIG. 10 to the position shown in FIG. 9 would result in a smaller step height, a higher or shallower step depth and a smaller travel distance or range for each of foot pad 62.

In the example illustrated, adjustment member 114 is rotatable between a continuum of different positions and may be retained in any one position along the continuum. In other embodiments, adjustment member 114 may alternatively rotate between a multitude of distinct discrete spaced positions at various predetermined angles about axis 74. In such an alternative embodiment, notches, detents or other retention mechanism may be used to define the distinct spaced positions at which adjustment member 114 may be retained.

Actuator 116 comprises a mechanism configured to move adjustment member 114. In the example illustrated, actuator 116 comprises a powered actuator driven by electrical power. In one embodiment, actuator 116 comprises an electric powered motor configured to drive a worm or lead screw arrangement to generate linear translation so as to rotate adjustment member 114 about axis 74. In yet another embodiment, actuator 16 may comprise an electric motor, such as a stepper motor, servomotor and the like, directly connected to a shaft secured to adjustment member 114 along axis 74 or connected to a shaft secured to adjustment member 114 by speed reducing device or gear train to selectively rotate adjustment member 114. In still other embodiments, actuator 116 may comprise electric solenoid or a hydraulic or a pneumatic piston-cylinder assembly operably coupled to adjustment member 114 so as to rotate adjustment member 114.

According to one embodiment, powered actuator 116 repositions adjustment member 114 to adjust the step height in response to control signals from a controller 146 associated with display 42. In one embodiment, such adjustment may be in response to a person depressing a button, sliding a slider bar, actuating a switch, entering a voice command to voice recognition software through microphone or other input. In another embodiment, such adjustment may be in accordance with a pre-programmed or predetermined exercise routine stored in memory, wherein the step height is to be adjusted during an exercise routine. Because such adjustment is powered and does not require a person to detach or disassemble any portion of exercise apparatus 20, such adjustment may be made "on-the-fly" during exercise as foot pads 62 are moving along a path. In other words, an exercise routine or workout need not be interrupted.

In other embodiments, actuator 116 may alternatively comprise a non-powered actuator. For example, actuator 116 may alternatively be configured to be manually powered, wherein force or motion applied by a person is mechanically transmitted to adjustment member 114 to reposition adjustment member 114. After adjustment, adjustment member 114 may be retained in place by one or more hooks, clamps, catches, detents or friction surfaces.

Although adjustment member 114 is illustrated as being rotated so as to reposition end mounts 98 and so as to adjust the step height of exercise apparatus 20, in other embodiments, the positioning of end mounts 98 may be adjusted in other fashions. For example, in another embodiment, end mounts 98 may alternatively be linearly movable or configured to slide or translate between different positions relative to frame 24 and relative to crank guides 72. In one embodiment, each of end mounts 98 may slide along the linear portions of side arm 56 and may be configured to be retained at various positions along side arm 56. In one embodiment, such movement and retention of end mounts 98 along side arms 56 may further be powered by a linear actuator such as a solenoid or a hydraulic or pneumatic piston-cylinder assembly mounted along or mounted inside side arm 56.

Figure 15:
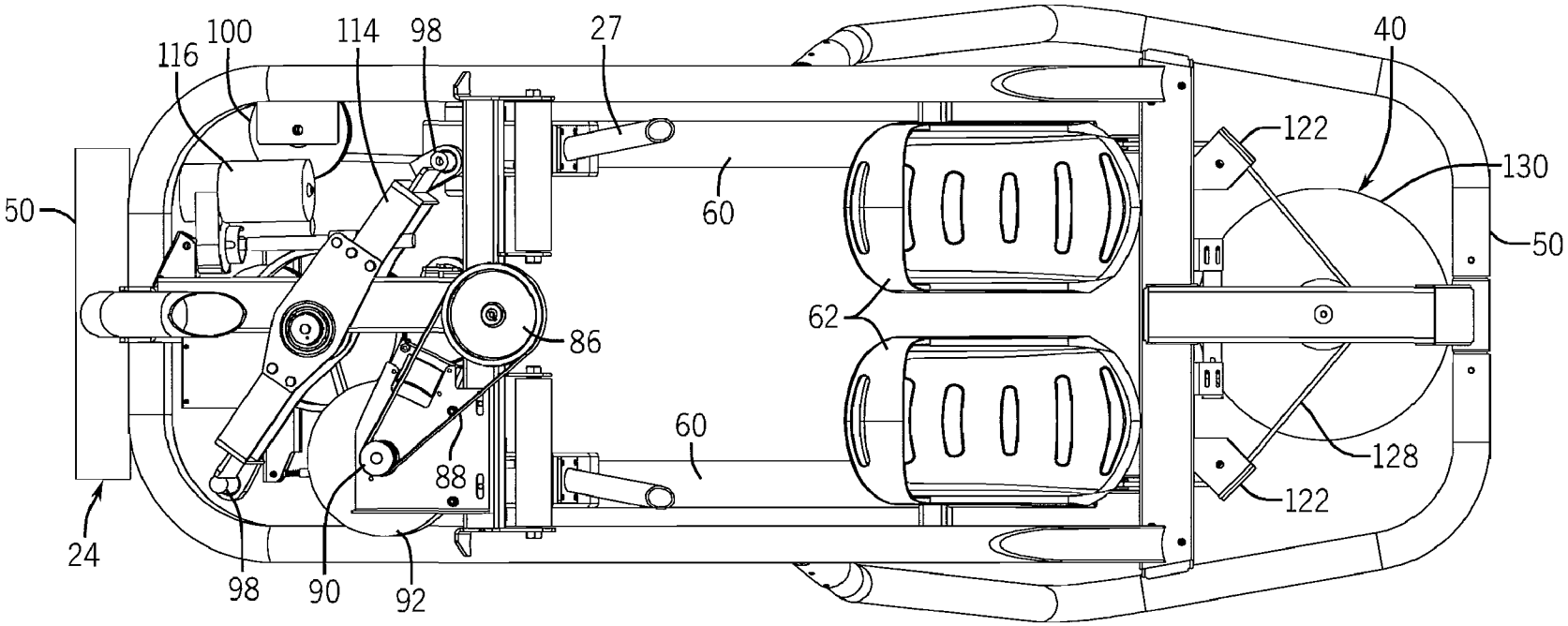
FIG. 15 is a bottom plan view of the exercise apparatus of FIG. 1 illustrating a resistance system according to an example embodiment.
Figure 16:
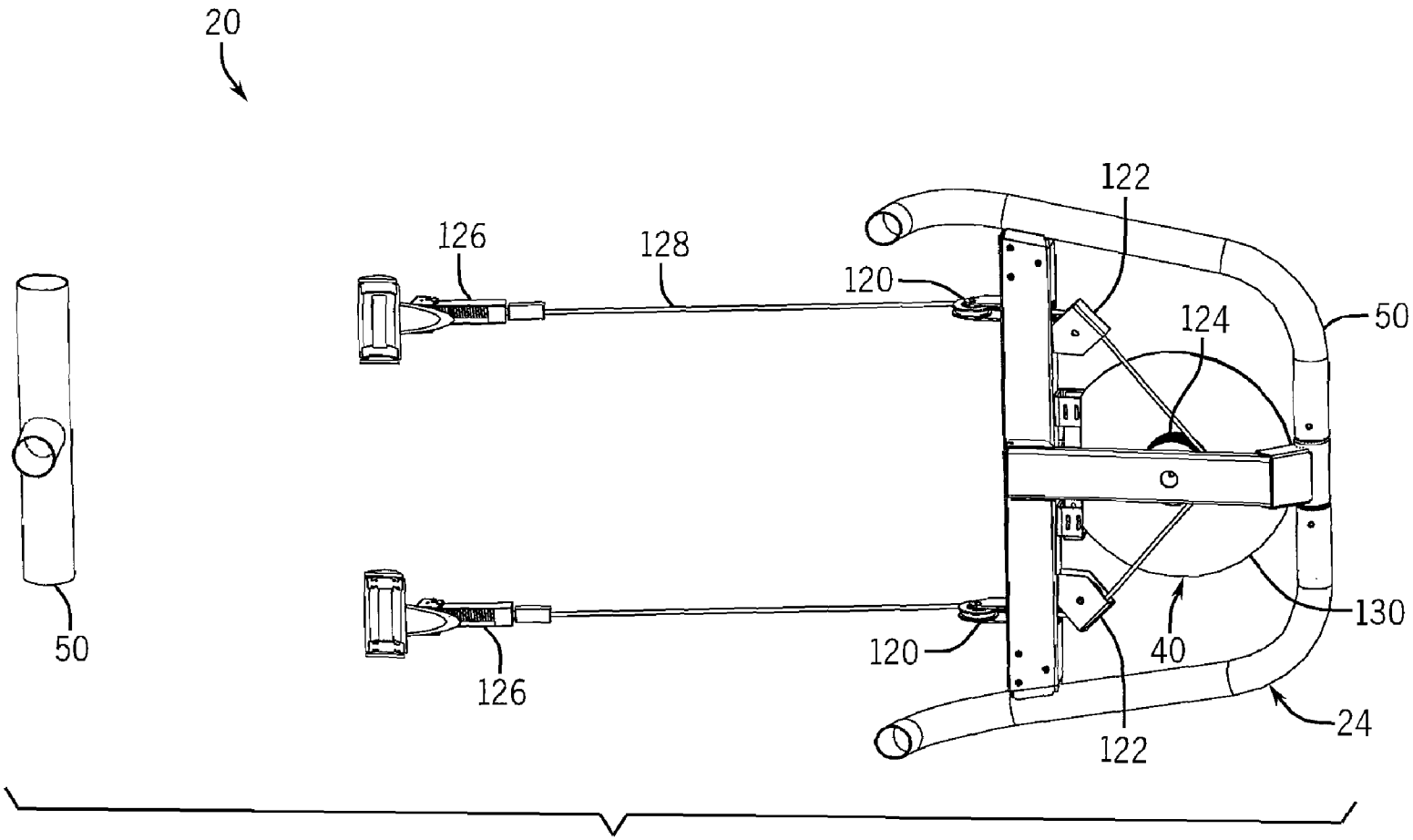
FIG. 16 is a sectional view of the exercise apparatus of FIG. 15 further illustrating the resistance system.

Horizontal resistance system 40 comprises a system configured to apply additional resistance to or against horizontal movement of foot support members 60 and footpads 62. FIGS. 15 and 16 illustrate resistance system 40 in more detail. FIG. 15 is a bottom plan view of exercise apparatus 20 while FIG. 16 is a bottom plan view of exercise apparatus 20 with portions removed for purposes of illustration. As shown by FIGS. 15 and 16, resistance system 40 includes flexible element guides 120, 122, pulley 124, linkage assembly mounts 126, flexible element 128 and resistance source 130.

Flexible element guides 120, 122 comprise structures supported by frame 24 which are configured to guide and direct movement of flexible element 128. In one embodiment, guides 120 and 122 comprise pulleys. In another embodiment, guides 120 and 122 may comprise stationary structures along which flexible element 128 glides or slides. Pulley 124 is connected to a shaft connected to resistance source 130 and also guides movement of flexible element 128. Pulley 124 is rotationally driven upon movement of flexible element 128 against the resistance provided by resistance source 130.

Linkage assembly mounts 126 secure flexible element 128 to linkage assemblies 26. In the example illustrated, mounts 126 comprise swivel, universal or pivot joints to accommodate the to and fro movement of foot support members 60. In other embodiments, flexible element 128 may be secured to foot support members 60 in other manners or may be secured to other portions of linkage assemblies 26. Flexible element 128 comprises an elongate flexible or bendable member such as a cable, wires, rope, belt, cord, string, strap, chain and the like having ends mounted or secured to linkage assemblies 26 by mounts 126, wherein flexible element 128 wraps about pulley 124.

Resistance source 130 comprises a mechanism configured to rotate against a selectively adjustable resistance. In one embodiment, resistance source 130 comprises a metal plate and one or more magnets forming an Eddy brake. In one embodiment, the one or more magnets comprise electromagnets, allowing the strength of the magnetic force to be selectively adjusted to control and vary the resistance applied against the rotation of pulley 124 and movement of flexible element 128. In another embodiment, resistance source 130 may comprise an electric generator. In still another embodiment, resistance source 130 may comprise two surfaces in frictional contact with one another so as to generate resistance against rotation of pulley 124. In another embodiment, air brakes may be utilized. In still other embodiments, other brakes or resistance mechanisms may be utilized. In one embodiment, the resistance applied by horizontal resistance source 130 may be selectively adjusted by a person using exercise apparatus 20. In one embodiment, the resistance may be adjusted in response to control signals generated by controller associated with display 24 in response to input from a person exercising or in response to a stored exercise routine or workout. In still other embodiments, horizontal resistance system 40 may be omitted.

Display 42 comprises a mechanism facilitating interface between exercise apparatus 20 and a person exercising. One embodiment of display 42 comprises inputs 140, outputs 142, communication interface 144 and controller 146 (each of which is schematically illustrated in FIG. 1). Inputs 140 comprise one or more mechanisms configured to facilitate entry of commands or information to exercise apparatus 20 from a person. In one embodiment, such inputs may comprise a touch screen, one or more push buttons, one or more slider bars, toggle switches, a microphone and voice recognition software and the like.

Outputs 142 comprise one or more devices configured to present information to a person. In one embodiment, outputs 142 may comprise a display screen, light emitting diodes, audible signal or sound generating devices and the like. Communication interface 144 comprises a mechanism facilitating communication between exercise apparatus 20 and external systems or devices such as a network, the Internet, or other exercise apparatus. Communication interface 144 may be configured to facilitate wired or wireless communication.

Controller 146 comprises one or more processing units configured to receive information or commands from inputs 140 or communication interface 144 as well as information or data from various sensors associated with exercise apparatus 20. Controller 146 further analyzes such information and generates control signals directing the display of information by display 142, the transmission of data or information or information requests via communication interface 144 and the operation of resistance sources 92, 130 as well as actuator 116.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 146 may be embodied as part of one or more application-specific integrated circuits (ASICs). Unless otherwise specifically noted, the controller 146 is not limited to any specific combination of hardware circuitry and software, nor to any particular source for the instructions executed by the processing unit.

During use of exercise apparatus 20, a person mounts footpad 62 while generally grasping side arms 56. The person exercising then inputs via inputs 148 desired workout or exercise routine or selects a pre-stored workout or exercise routine. In response to such inputs, controller 146 may generate control signals adjusting the amount of resistance applied by resistance sources 92 and 130. In addition, controller 146 may generate control signals causing powered actuator 116 to reposition end mounts 98 to adjust the step height. During the exercise routine, the person exercising may decide to adjust his or her stride or the path of his or her stride. This is achieved by the person simply applying a different force to footpad 62 and linkage assemblies 26. In addition, the person exercising may decide to increase or decrease the step height. To do this, the person may simply enter a change using input 140, wherein controller 146 generates control signals causing actuator 116 to reposition adjustment member 114 to adjust the step height. As noted above, this adjustment may be made on the fly during exercise. In other embodiments, controller 146 may automatically adjust the resistance applied by one or both of resistance sources 92, 130 as well as the step height controlled by step height adjustment mechanism 38 in accordance with stored exercise routine or workout. Such changes may be made based upon the lapse of time from the beginning of the workout, based upon time remaining in the workout, based upon sensed biometrics of the person exercising or based upon predetermined speed, force or motion path objectives or targets being met or not being met. Because exercise apparatus 20 enables the maximum step height or maximum step depth to be automatically adjusted by controller 146 or to be adjusted by a person during exercise, exercise apparatus 20 provides more flexible or versatile exercise options and a more enjoyable workout.

FIGS. 17-23 illustrate exercise device or apparatus 320 according to an example embodiment. Exercise device or apparatus 320 allows a person to adjust a horizontal length of his or her stride simply by the person applying force to foot supports of the exercise apparatus. Exercise apparatus 320 further allows the person to also adjust a vertical length or vertical step height. Exercise apparatus 320 provides such freedom of motion using flexible elements 404 and 406 in an architecture that is compact, less complex and less expensive.

As shown by FIGS. 17-23, exercise apparatus 320 comprises frame 324, linkage assemblies 326L, 326R (collectively referred to as linkage assemblies 326), swing arms 327R, 327L (collectively referred to as swing arms 327), crank system 328, resistance system 330, coupling systems 334L, 334R (collectively referred to as coupling systems 334), step height adjustment mechanism 338, horizontal resistance system 340 and display 342.

Figure 18:
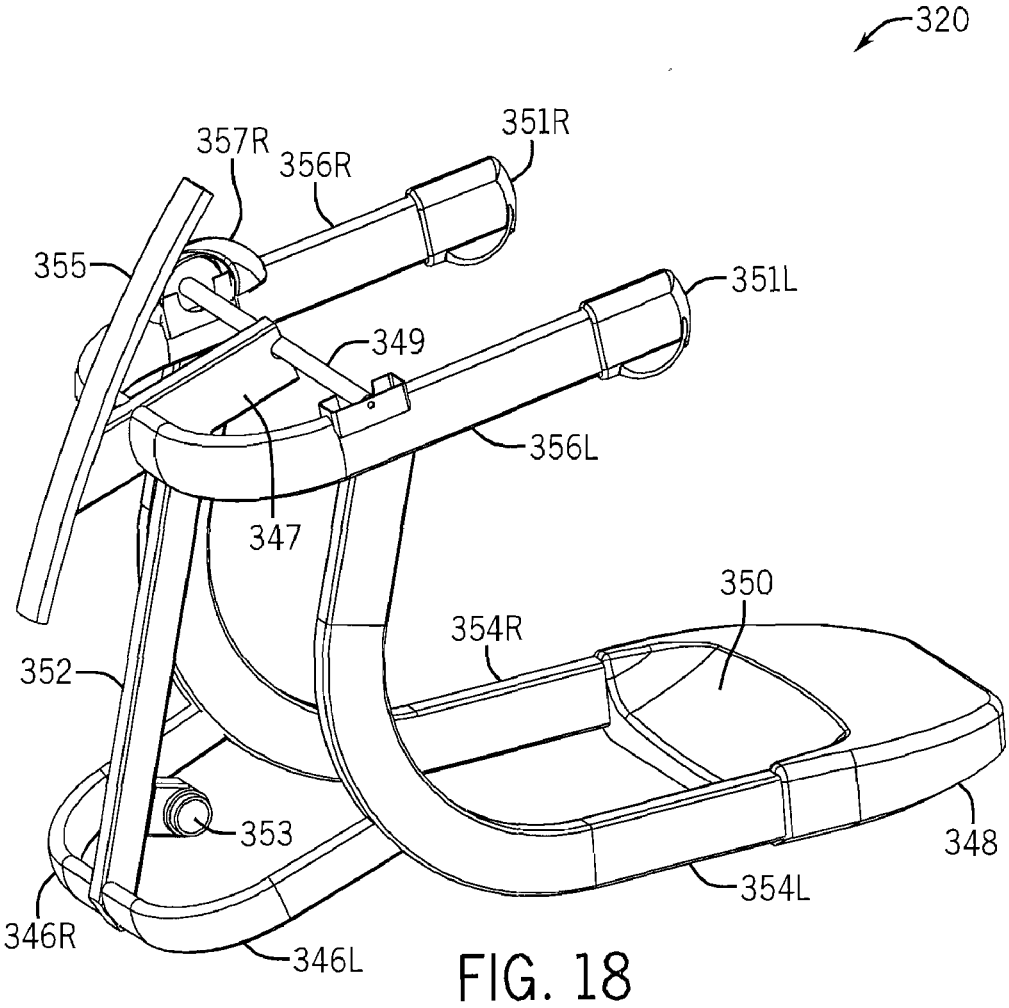
FIG. 18 is another top perspective view of a portion of the exercise apparatus of FIG. 17.

Frame 324 supports exercise apparatus 320 upon a base or floor. As illustrated in FIG. 18, frame 324 includes rear base portion 350, front or forward post or leg 352, rear supports or legs 354R, 354L (collectively referred to as rear supports 354), side arms 356L, 356R (collectively referred to as side arms 356), front support 355, front supports 346R, 346L (collectively referred to as front supports 346), front support 347, cross-shaft 349, end caps 351R, 351L (collectively referred to as end caps 351), covers 357R, 357L (collectively referred to as covers 357) and crank support 353. Base portion 350 bears against the floor and is connected to rear supports 354. The bottom of forward post 352 bears against the floor. Forward post 352 extends at a forward end of exercise apparatus 320 and is connected to and supports front support 347. Front support 347 connects to and supports side arms 356 and cross-shaft 349. Front supports 346 connect front post 352 to rear supports 354. Platform 348 connects to rear supports or legs 354 and covers rear support 350. Front support 355 connects to front support 347 and supports display 342. Side arms 356 and front support 347 support cross-shaft 349. Rear supports or legs 354 extend toward the rear end of exercise apparatus 320 and are connected to side arms 356. End caps 351R, 351L (collectively referred to as end caps 351) and covers 361R, 361L (collectively referred to as covers 361) connect to side arms 356.

Side arms 356 extend rearwardly from leg 352 and front support 347 on opposite sides of both linkage assemblies 326. Side arms 356 extend substantially parallel to one another at the same vertical height. Side arms 356 provide bars, beams or shafts by which a person's left and right hands may grasp or rest upon when mounting exercise apparatus 320 or when otherwise not grasping handle portions 366R, 366L (collectively referred to as handle portions) of swing arms 327. Side arms 356 help retain a person on linkage assemblies 326 and on exercise apparatus 320 and reduce the likelihood of a person falling off of exercise apparatus 320. Side arms 356 assist in supporting cross-shaft 349 and portions of coupling systems 334. Side arms 356 further serve as shields about flexible elements of couplings systems 334. End caps 351 and covers 357 cover portions of coupling systems 334 by attachment to side arms 356.

Forward post 352 supports front support 347, crank support 353, resistance system 330, step height adjustment mechanism 338 and horizontal resistance system 340. For ease of illustration, portions of post 352, such as brackets or support plates extending forwardly from post 352 are omitted.

Cross-shaft 349 supports linkage assemblies 326, swing arms 327 and portions of coupling assemblies 334. Front supports 346 provide additional support between front post 352 and rear supports 354.

Crank support 353 supports portions of crank system 328 and portions of step height adjustment mechanism 338. Crank support 353 comprises a plate, beam, bar, channel or similar element firmly attached to the rearward side of front post 352. Crank support 353 also comprises operable attachment elements for portions of crank system 328 and step height adjustment mechanism 338. Such operable attachment elements include shafts, hubs, collars, pins, levers or similar elements to allow for movement of crank system 328 potions and step height mechanism 338 portions around a horizontal centerline 374. In another embodiment, support for portions of step height mechanism 338 may be omitted from crank support 353. In some embodiments, crank support 353 may be attached forward of front post 352 or be supported by other portions of frame 324.

Platform 348 provides a location from which the user of exercise apparatus 320 may mount foot pads 362R, 362L (commonly referred to as foot pads) of linkage assemblies 326.

Linkage assemblies 326 comprise one or more members movably supported by frame 324 and configured to elevate and support a person's feet as the person exercising applies force to such linkage assemblies to move such linkage assemblies relative to frame 324. Linkage assemblies 326 are coupled to one another so as to automatically move 180 degrees out of phase with respect to one another when opposing forces are applied to linkage assemblies 326. The person exercising exerts force on foot pads 362 and foot support members 360, alternating right and left, while also pushing and pulling on linkage assemblies 326 to create the out of phase movement of linkage assemblies 326. In other embodiments, other means of synchronization may be used.

Figure 19:
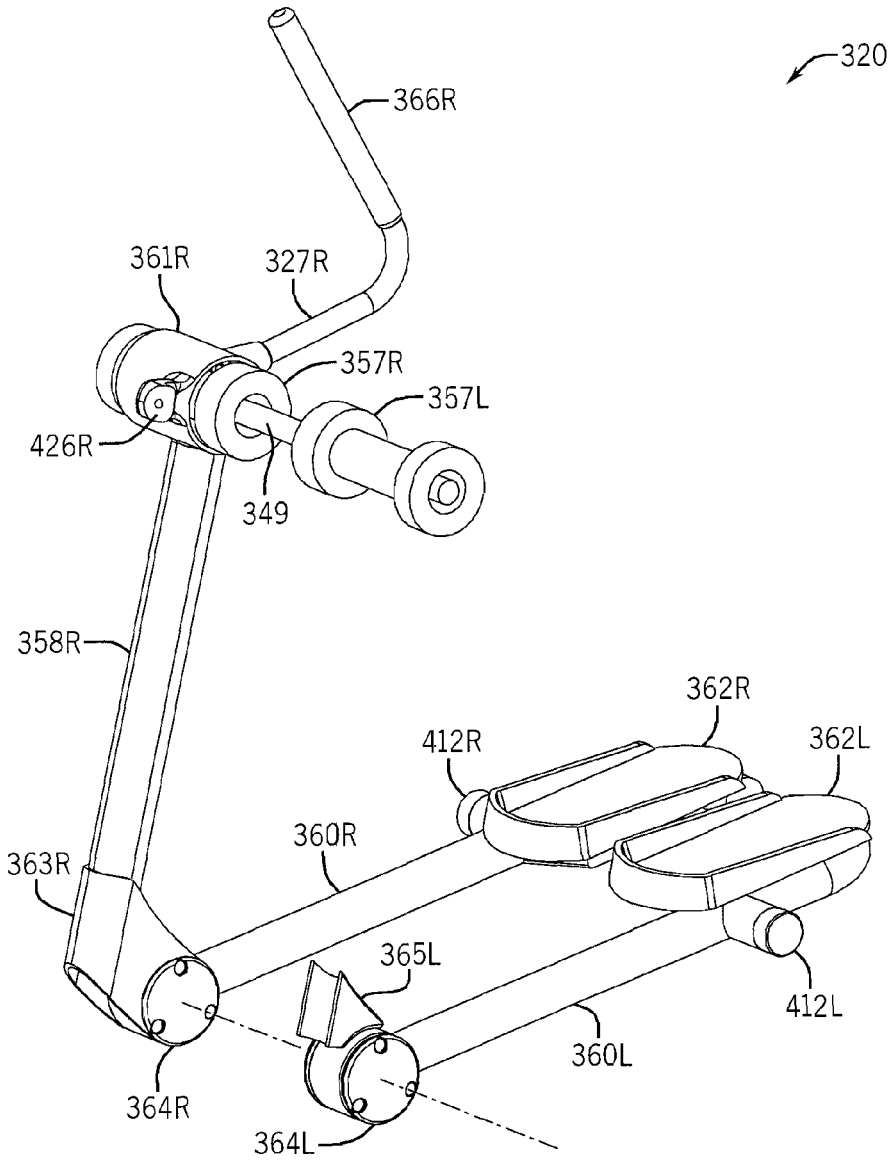
FIG. 19 is another top perspective view of a portion of the exercise apparatus of FIG. 17.

As illustrated in FIG. 19, each of linkage assemblies 326 includes motion members 358R, 358L (collectively referred to motion members 358), torque bars 359R, 359L (collectively referred to torque bars 359), foot support members 360R, 360L (collectively referred to as foot support members 360), hubs 361R, 361L (collectively referred to as hubs 361), foot pads 362R, 362L (collectively referred to as foot pads 362), saddles 363R, 363L (collectively referred to as saddles 363), joints 364R, 364L (collectively referred to as joints 364) and joint covers 365R, 365L (collectively referred to as joint covers 365).

Torque bars 359 are supported by cross-shaft 349. Torque bars 359 are spool-shaped including a center portion of one diameter and end portions of diameters larger than the diameter of the center portion. Each of torque bars 359 includes a circular hole located on its radial centerline and extending along its entire length. The inside diameter of the circular hole is slightly larger than the outside diameter of cross-shaft 349. Torque bars 359 mount on to cross-shaft 349 such as to allow rotational movement of torque bars 359 on cross-shaft 349. The rotational movement of torque bars 359 creates resulting rotational movement or winding and unwinding of portions of coupling systems 334.

Each of hubs 361 is a circular element with a hollow center that is mounted on the smaller diameter portion of one of torque bars 359. Hubs 361 pivotally connect swing arms 327 and motion members 358. The rearward sides of hubs 361 are attached to swing arms 327. The bottom sides of hubs 361 are attached to motion members 358. The forward sides of hubs 361 are attached to portions of coupling systems 334.

Motion members 358 are essentially vertical components that transfer movement from hubs 361 to lower portions of linkage assemblies 326. Motion members 358 are attached to saddles 363 and joint covers 365. Each of saddles 363 wrap around the forward side of the lowest part of one of motion members 358 and are attached to motion members 358. Each of saddles 363 has one or more arms that attach to joints 364. Each of joint covers 365 attach to the rearward side of one of motion members 358 immediately above joint 364. The combination of saddles 363, joints 364 and joint covers 365 pivotally connect motion members 358 to foot support members 360. In other embodiments, motion members 358 and foot support members 360 may be pivotally connected other means such as knee braces, welded hubs or the like.

Each foot support member 360 (also known as a stair arm) extends essentially horizontally from one of joints 364 and supports one of foot pads 362. Each foot pad 362 comprises a paddle, pedal, or the like providing a surface upon which a person's foot may rest. Each foot pad 362 further includes a toe cover or toe clip against which a person's foot or toes may apply force in an upward or vertical direction. Foot pads 362 may have a variety of different sizes, shapes and configurations. In other embodiments, each motion member 358 and foot support member 360 (sometimes referred to as a foot link) may also have different configurations, shapes and connections. For example, in other embodiments, a lieu of foot support member 360 having a rear end which is cantilevered, foot support member 360 may alternatively have a rear end which is pivotally supported by another supporting linkage extending from one of side arms 356 or another portion of frame 324.

Swing arms 327 comprise arms having handle portions 366 configured to be grasped by a person while linkage assemblies 326 are pivoted relative to frame 324. In the example illustrated, swing arms 327 are rigidly connected to hubs 361 which are also rigidly connected to motion members 358. Swing arms 327, hubs 361 and motion members 358 comprise a fixed arrangement that pivots around cross-shaft 349. As a result, swing arms 327 permit a person to exercise his or her arms and upper body. In other embodiments, swing arms 327 may pivot independent of linkage assemblies 326, may have independent resistance systems for exercising the upper body or may be rigidly or stationarily supported by frame 324. In some embodiments, swing arms 327 may be omitted.

Figure 20:
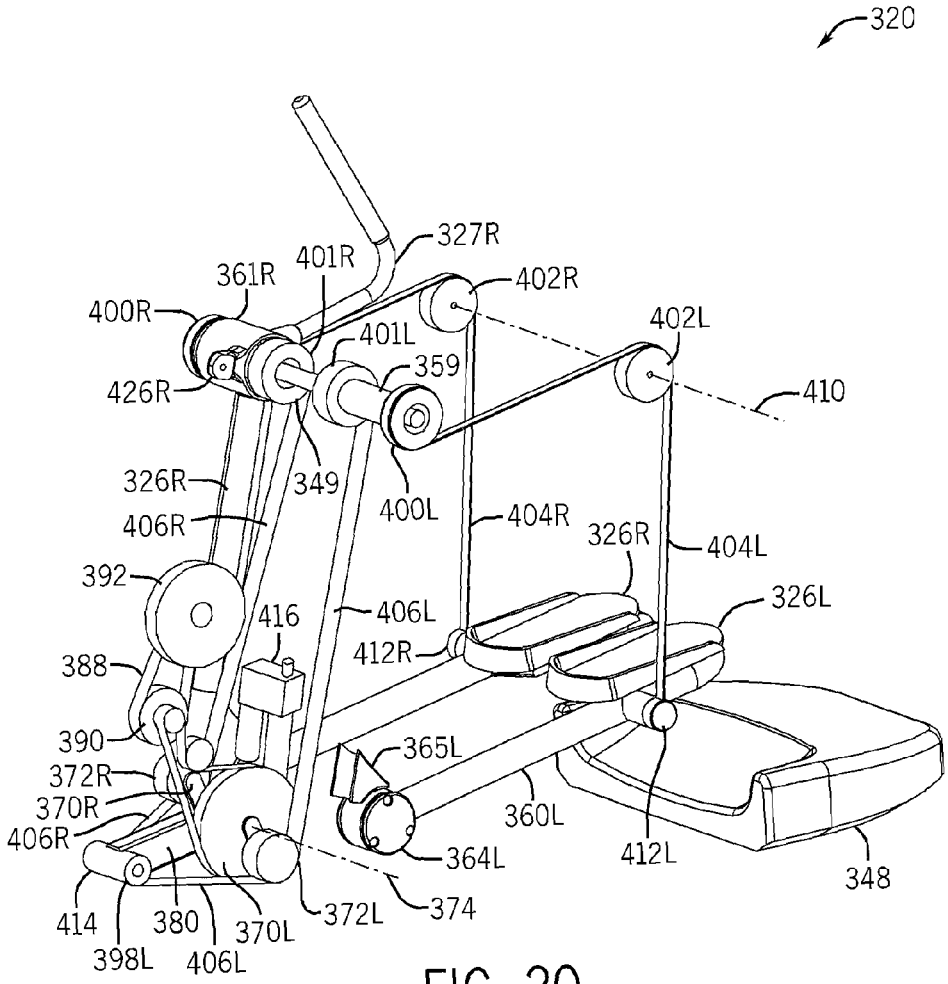
FIG. 20 is another top perspective view of a portion of the exercise apparatus of FIG. 17.
Figure 22:
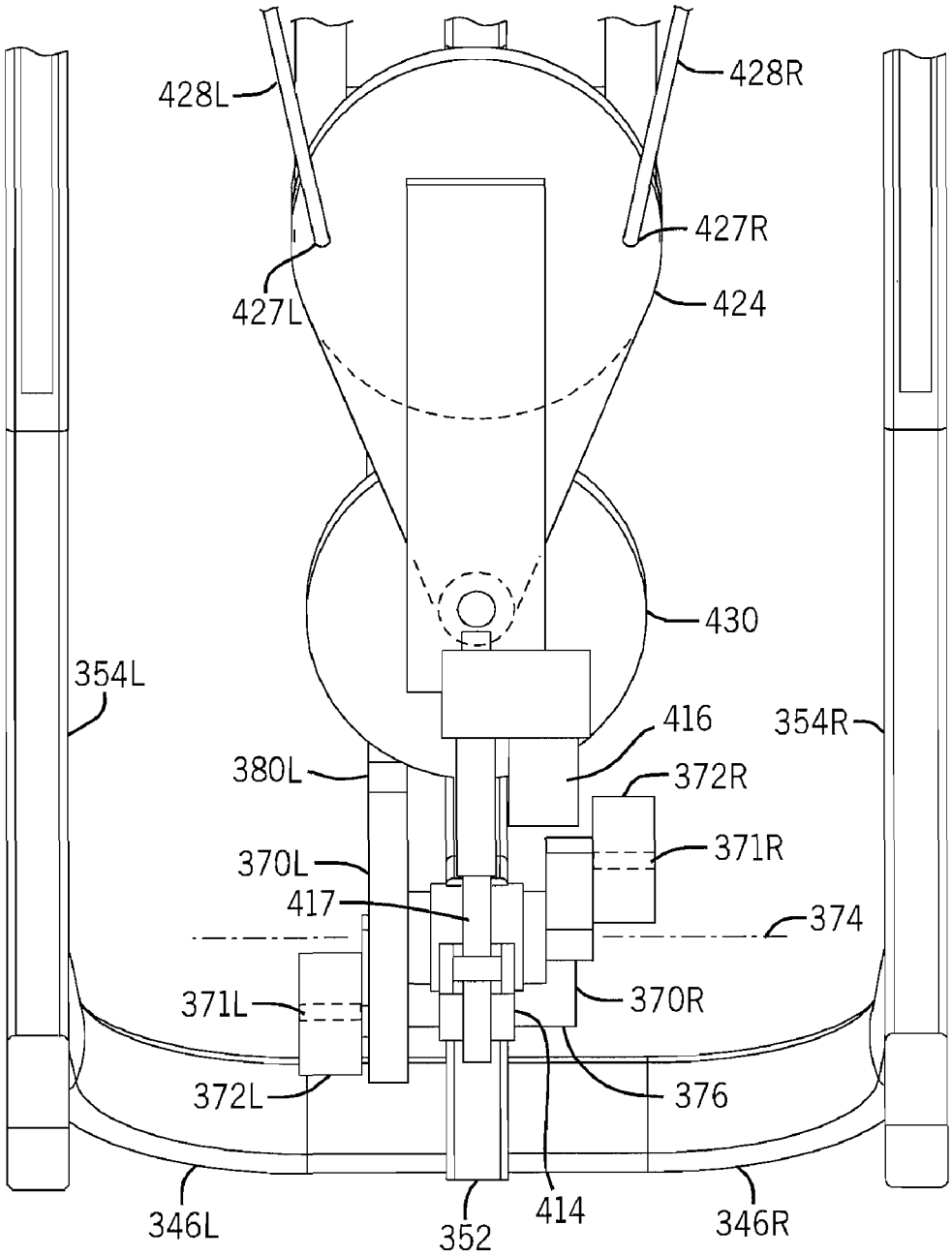
FIG. 22 is a partial rear elevational view of a portion of the exercise apparatus of FIG. 17.

FIGS. 20 and 22 illustrate crank system 328 in more detail. Flexible element portions of coupling systems 334 are omitted from FIG. 22 for ease of illustration. Crank system 328 comprises a mechanism configured to synchronize movement of linkage assemblies 326 and to apply a resistance to such movement. As shown by such figures, crank system 328 crank arms or cranks 370R, 370L (collectively referred to as crank arms 370), crank guide arms 371R, 371L (collectively referred to as crank guide arms 371), flexible element crank guides 372R, 372L (collectively referred to as flexible element crank guides 372) and crank shaft 376.

Cranks 370 transfer force and movement from coupling systems 334 to resistance system 330. Cranks 370 are attached to and supported by crank shaft 376. Crank shaft 376 is supported by crank support 353 in a manner to allow rotation of crankshaft 376 and cranks 370 about horizontal axis 374. Because cranks 370 rotate about a substantially horizontal axis 374 which is positioned near forward post 352, crank system 328 is more compact. In yet other embodiments, crank system 328 may be located elsewhere within the confines of frame 324.

In the example illustrated, crank 370L comprises a combined input crank and sheave in the form of a disk, wheel or the like, wherein the disc or wheel concentrically extends about axis 374. In other embodiments, crank 370L may comprise one or more members configured to rotate about axis 374, wherein crank 370L does not concentrically extend about axis 374. In other embodiments, crank 370L may rotate about a vertical axis in a manner such as illustrated for exercise apparatus 20.

Crank 370R is fixed to crank 370L so as to rotate with crank 370L. In the example illustrated, crank 370R comprises an arm radially extending outward from shaft 376 and supporting guide 372R towards its outer radial end. Crank 370R supports flexible element crank guide 372R attached to crank arm 370R at crank guide arm 371R. Crank 370L includes flexible element crank guide 372L attached to crank arm 370L at crank guide arm 371L.

Crank guide arms 371 and flexible element crank guides 372 are located on crank arms 370 at points that are equidistant and radially spaced from axis 374. The locations of crank guide 372R and crank guide 372L are positioned 180 degrees out of phase from each other. Flexible element crank guides 372 comprise members that are connected to and carried by cranks arms 370 so as to rotate about axis 374 and about which front flexible elements 406 (406R, 406L) of coupling system 334 wrap so as to transmit force to crank guides 372 and ultimately to cranks 370. In the example illustrated, flexible element crank guides 372 comprise a pulley. In other embodiments, flexible element crank guides 372 may alternatively comprise a spool or disc against which a flexible element moves or slides without rotation of the flexible element crank guide 372.

Resistance system 330 applies additional resistance to the rotation of crank system 328. In the particular example illustrated, resistance system 330 provides a selectively adjustable incremental resistance to the rotation of cranks 370 of crank system 328. Resistance system 330 includes belt 380, speed changer 390, belt 388 and resistance source 392. In the illustrated embodiment, speed changer 390 comprises a step up pulley. Belt 380 wraps about one of cranks 370 and the smaller wheel of speed changer 390. Belt 388 wraps about the larger wheel of speed changer 390 and also about the shaft of resistance source 392. The attachment of resistance source 392 to front post 352 adjacent to cranks 370 and with horizontal axis of rotation allows for a more compact and efficient design for exercise apparatus 320. In other embodiments, chain and sprocket arrangements, dear trains and other transmissions may be used to operatively couple cranks 370 to resistance source 392.

Resistance source 392 comprises a mechanism configured to rotate against a selectively adjustable resistance. In one embodiment, resistance source 392 comprises a metal plate and one or more magnets forming an Eddy brake. In one embodiment, the one or more magnets comprise electromagnets, allowing the strength of the magnetic force to be selectively adjusted to control and vary the resistance applied against the rotation of cranks 370. In another embodiment, resistance source 392 may comprise an electric generator. In still another embodiment, resistance source 392 may comprise two surfaces in frictional contact with one another to apply a frictional resistance against rotation of cranks 370. In another embodiment, air brakes may be utilized. In still other embodiments, other brakes or resistance mechanisms may be utilized.

Because resistance system 330 utilizes a two-stage transmission between cranks 369 and resistance source 392, the arrangement or architecture of crank system 328 and resistance system 330 is more compact and the speed ratio between cranks 370 and resistance source 392 (approximately 12:1) provides improved electric performance. In other embodiments, a single stage or a transmission with greater than two stages may be employed. In yet other embodiments, resistance system 330 may have other configurations or may be omitted. For example, in another embodiment, the transmission of resistance system 330 may include gear trains, chains and sprockets or the like.

Figure 17:
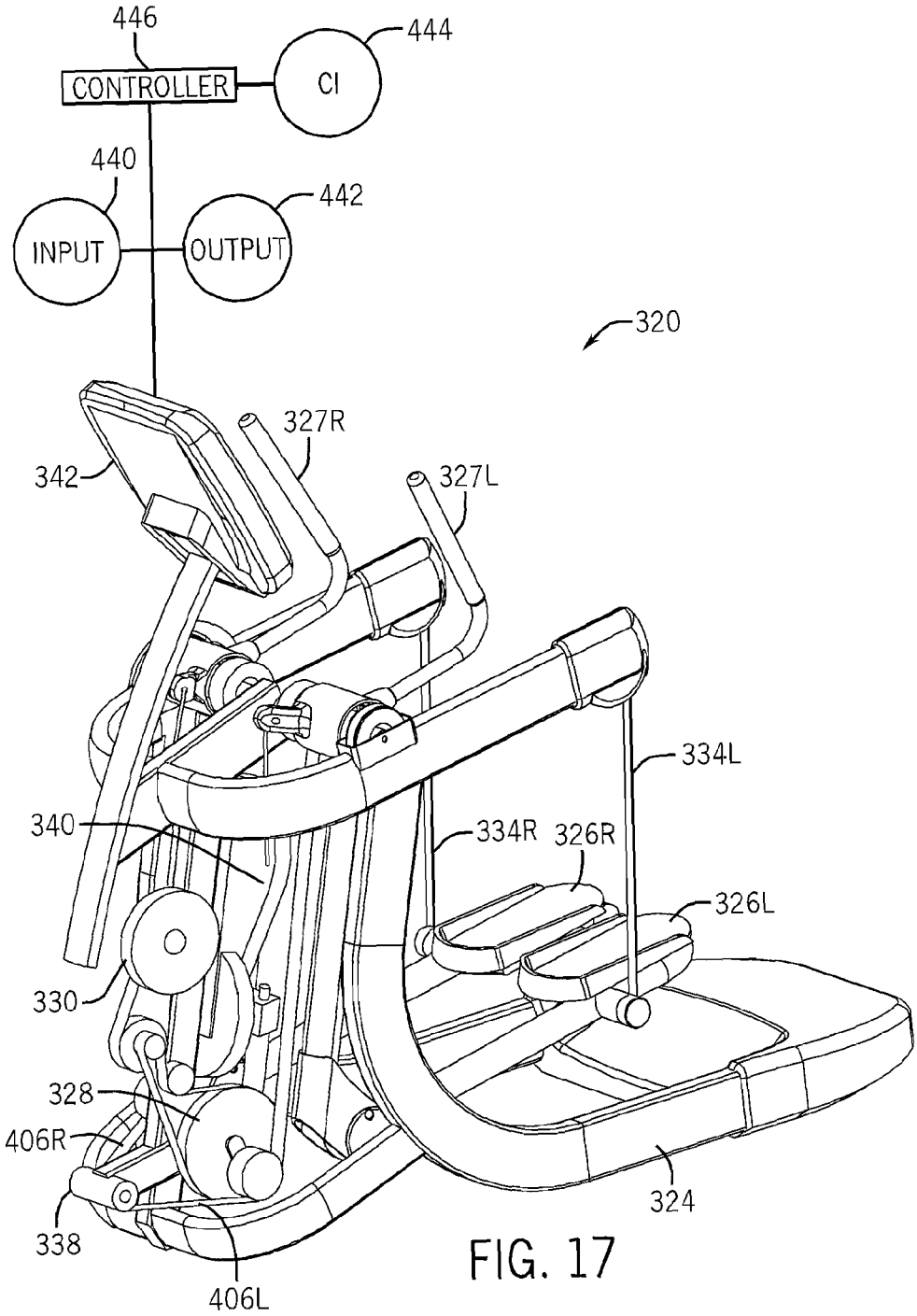
FIG. 17 is a top left perspective view of an exercise apparatus according to an example embodiment with portions schematically shown.
Figure 17A:
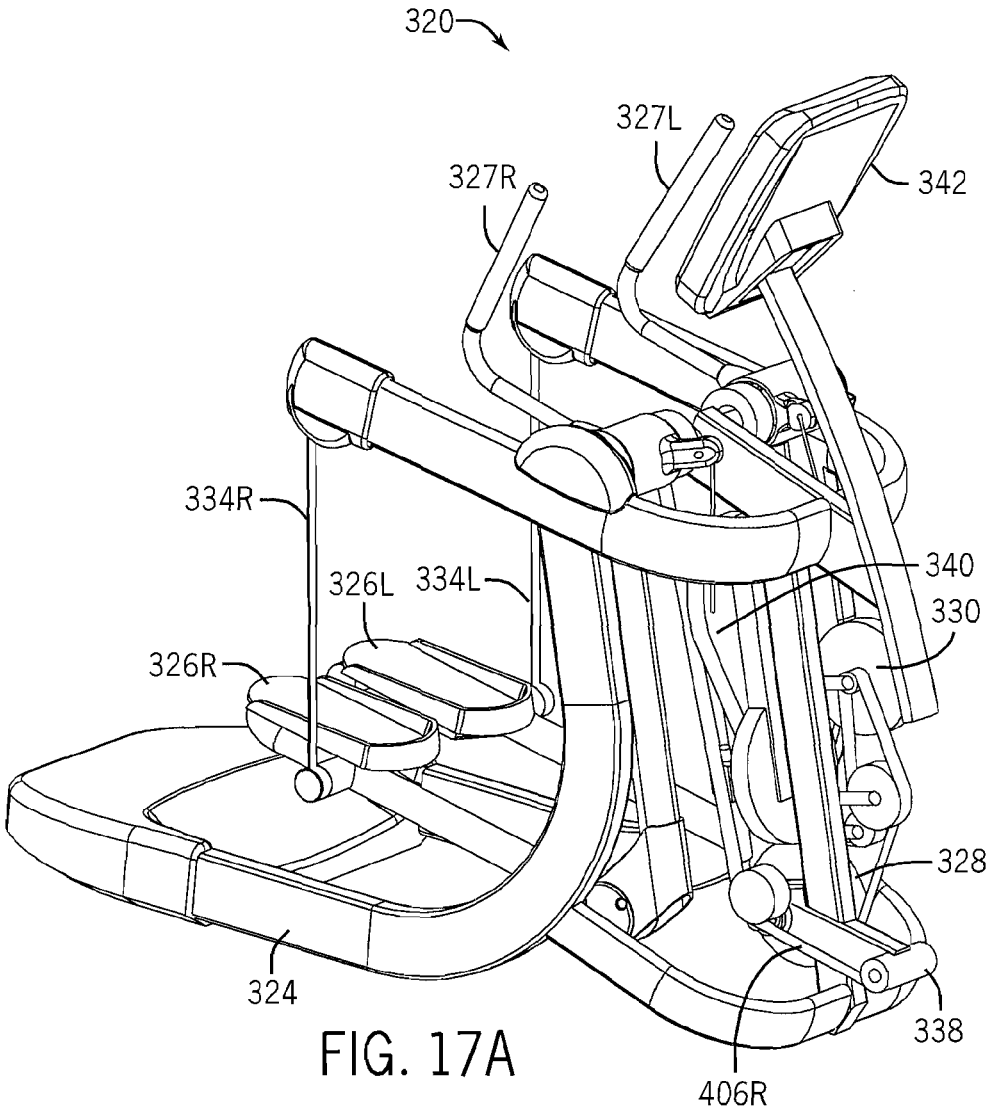
FIG. 17A is a top right perspective view of the exercise apparatus of FIG. 17.

As best shown by FIGS. 17, 17A and 20, coupling system 334 operably couples or joins step height adjustment system 338 to foot support members 360 or footpads 362. Coupling systems 334 include front end flexible element mounts 398R, 398L (collectively referred to as front end flexible element mounts 398), front flexible elements 406R, 406L (collectively referred to as front flexible elements 406), torque bar inboard flexible element mounts 401R, 401L (collectively referred to as torque bar inboard flexible element mounts 401), torque bar outboard flexible element mounts 400R, 400L (collectively referred to as torque bar rear flexible element mounts 404), rear flexible elements 404R, 400L (collectively referred to as rear flexible elements 404), rear guide elements 402R, 402L (collectively referred to as rear guide elements 402 and foot pad flexible element mounts 412R, 412L (collectively referred to as foot pad flexible element mounts 412).

Front flexible elements 406 and rear flexible elements 404 comprise flat belts of fiber reinforced polymer. In one embodiment, elements 404 and 406 comprise Kevlar reinforced polyurethane. Fiber reinforced polymer provides the advantage of durability for flexible elements 404 and 406. In another embodiment, one or more of front flexible elements 406 and rear flexible elements 404 may comprise bendable members such as cables, wires, ropes, belts, cords, strings, chains, and the like. In another embodiment, one or more of front flexible elements 406 and rear flexible elements 404 may comprise belts of materials other than fiber reinforced polymer.

As shown by FIG. 20, front end flexible element mount 398 (also known as a "dead end") comprises a mount or securement point at which an end of front flexible element 406 is attached. In the example illustrated, end mount 398 for each of coupling systems 334 is provided by step height adjustment mechanism 338. In other embodiments in which step height adjustment mechanism 338 is omitted, front end flexible element mount 398 may be provided by part of frame 324. In still other embodiments in which the ends of flexible elements 406 are directly attached to cranks 370 and do not wrap about a flexible elements crank guide 372, end mounts 398 may be provided on cranks 370.

Torque bar inboard flexible element mounts 401 comprise the spool ends of torque bars 359 that are located nearest to the longitudinal centerline of cross-shaft 349. Torque bar outboard flexible element mounts 400 comprise the spool ends of torque bars 359 that are located nearest to the longitudinal ends of cross-shaft 349.

Front flexible elements 406 wrap around flexible elements crank guides 372 and also wrap around from below and toward the rearward side of torque bar inboard flexible element mounts 401. As viewed from the left side of exercise apparatus 320, front end flexible elements 406 wrap around torque bar inboard flexible elements mounts 401 in a counter-clockwise direction. The rearward ends of front flexible elements 406 attach to torque bar inboard flexible element mounts 401. The forward ends of rear flexible elements 404 attach to torque bar outboard flexible elements mounts 400. Rear flexible elements 404 wrap from above and toward the forward side of torque bar outboard flexible element mounts 400 in a counter-clockwise direction as viewed from the left side of exercise apparatus 320. The method of attachment of front flexible elements 406 to torque bar inboard flexible elements mounts 401 and of rear flexible elements 404 to torque bar outboard flexible element mounts 400 serves to laterally transmit torque back and forth between elements 406 and 404 through torque bar 359 in an wind/unwind motion.

A shown by FIG. 20, the torque bar flexible element mounts 400 guide and direct movement of the rear flexible elements 404 to the interior of side arms 356 and toward rear guide elements 402.

In the example illustrated, rear guide elements 402 comprise pulleys rotationally supported by side arms 356 of frame 324 proximate to a rear end of exercise apparatus 320 substantially vertically above footpads 362 when footpads 362 are longitudinally aligned. In other embodiments, each of rear guide elements 402 may alternatively comprise a low friction surface which does not rotate and against which flexible elements 404 moves or slides.

As shown by FIG. 20, each of guide elements 402 further guides and directs flexible element 404 through an opening from an interior of side arm 356 in a substantially vertical direction down to foot support members 360 and footpads 362. In the example illustrated, guide elements 402 rotate about a substantially horizontal axis 410. Although coupling systems 334 are illustrated as having one guide element 402, in other embodiments, coupling systems 334 may alternatively include a greater or fewer of such guide elements.

In the example illustrated, the rearward end of rear flexible elements 404 is fixed to a foot support member 360 by a mount 412 at a location transversely opposite to footpad 362 near or proximate to a forward end of footpad 362. In the example illustrated, each mount 412 includes a body that slides (via screw adjustment) up and down relative to a pivoting block attached to the associated member 360, wherein flexible element 404 is fixed or secured to the body of the mount. Each mount 412 allows the location of members 360 to be adjusted so as to be level with one another. In other embodiments, mounts 412 may comprise other securement mechanisms such as clamps, fasteners and the like. In another embodiment, flexible element 404 may be clamped to mount 412 as described herein for exercise apparatus 20.

Each rear flexible element 404 extends from mount 412 in a substantially vertical direction until engaging rear guide 402. Rear flexible element 404 wraps partially about rear guide element 402 into an interior of one of side arm 356. Rear flexible element 404 extends through the interior of side arm 356 until engaging torque bar outboard flexible element mount 400. Movement is translated from the rear flexible element 404 to the front flexible element 406 through torque bar 359. Front flexible element 406 extends from torque inboard flexible element mount 401 and wraps around flexible elements crank guides 372. Finally, the front end of each front flexible element 406 is secured to one of front end mounts 398.

Because each of coupling systems 334 employs flexible elements (404 and 406) rather than rigid inflexible members or elements, forces may be more smoothly transmitted across convoluted paths, allowing coupling systems 334 and crank system 328 to be more compactly arranged and to be less complex and expensive. In addition, flexible elements (404 and 406) also have a reduced diameter as compared to rigid elements which permits the transmission of forces from linkage assemblies 326 to crank system 328 in even a more compact fashion. In other embodiments, at least segments or portions of front flexible elements 406 or rear flexible elements 404 may alternatively be replaced with rigid inflexible members or elements.

Step height adjustment mechanism 338 is configured to provide foot support members 360 and foot pads 362 with a multitude of different user selectable maximum upper and lower vertical ranges of motion. Adjustment mechanism 338 allows a person to adjust a maximum step height or a maximum step depth of a path through which the left and right foot supports 360 may move.

Figure 21:
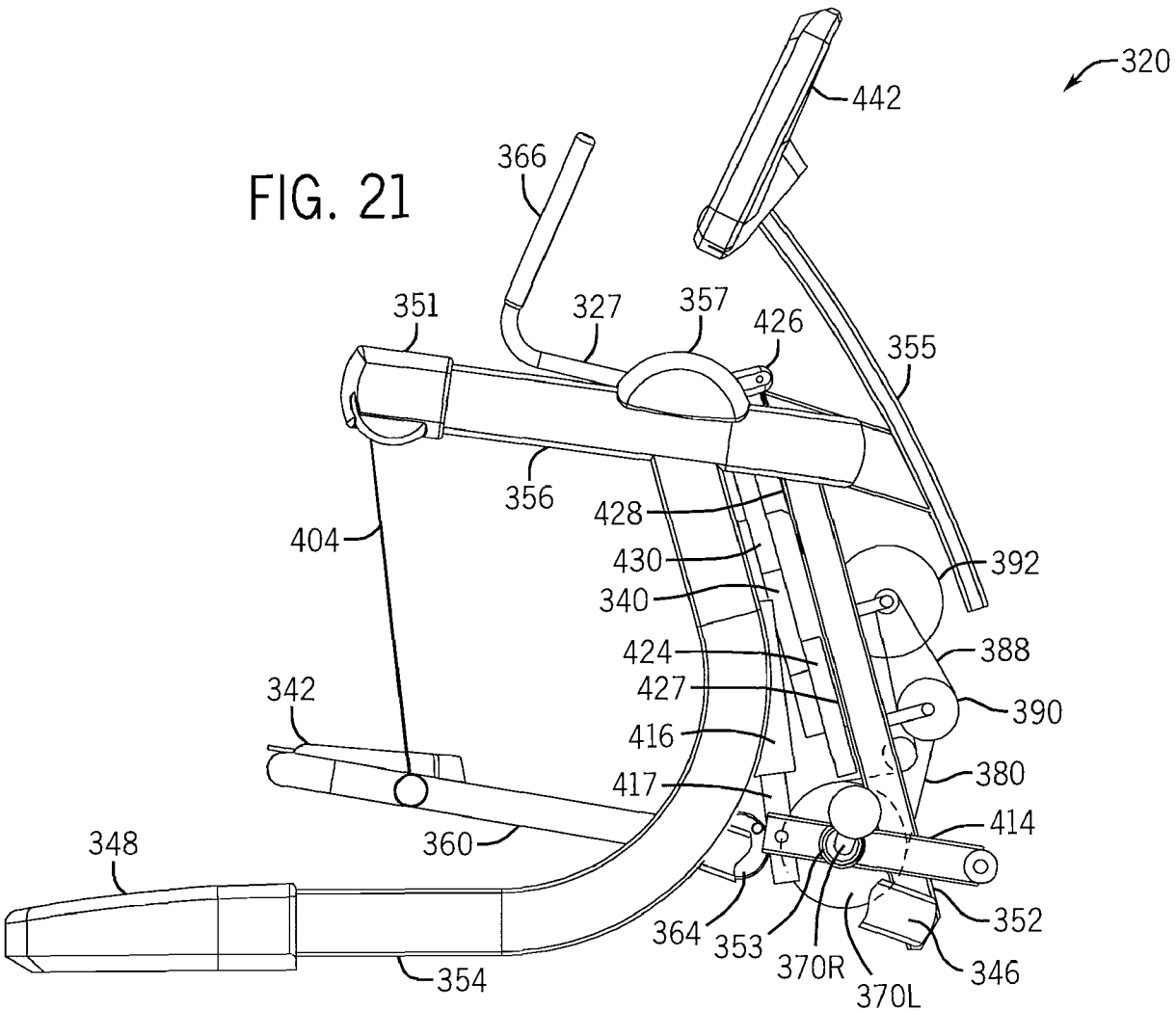
FIG. 21 is a right side elevational view of the exercise apparatus of FIG. 17.
Figure 23:
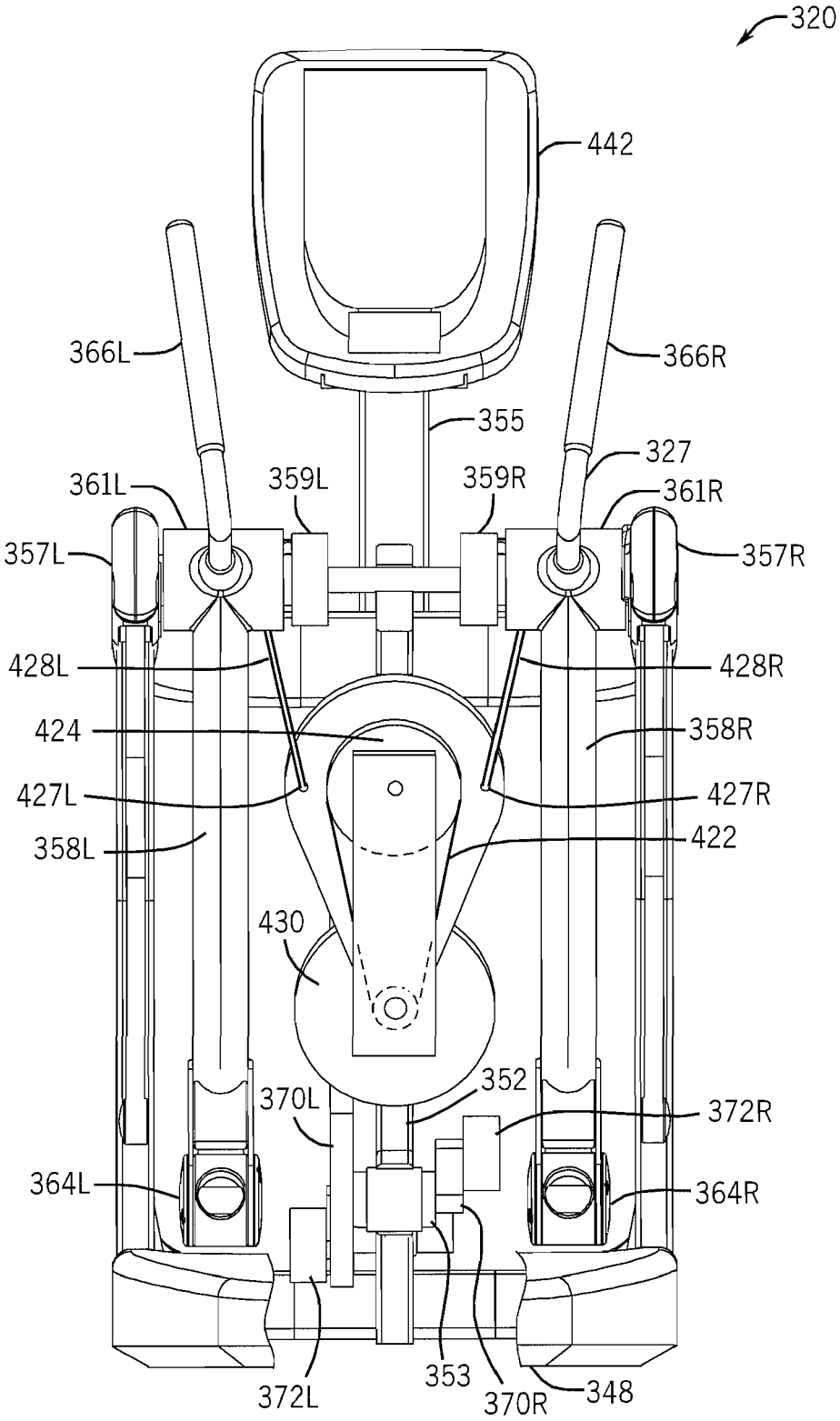
FIG. 23 is a rear elevational view of a portion of the exercise apparatus of FIG. 17.

As shown by FIGS. 21-23, step height adjustment mechanism 338 comprises adjustment member 414 and actuator 416 connected by linkage 417. Step height adjustment mechanism 338 changes the location of front end flexible element mounts 398 which, in turn, modifies the paths of front flexible elements 406 and rear flexible elements 404 and adjusts the positions of foot pads 362.

Adjustment member 414 pivots vertically about a horizontal axis at the center of its attachment to frame 324. Front end flexible elements mounts 398 are located on the forward end of adjustment member 414. The rearward end of adjustment member 414 is connected to actuator 416 by linkage 417. As viewed from the left side of exercise apparatus 320, movement of linkage 417 downward pivots adjustment member 414 in a clockwise direction which increases the vertical position of front flexible element mounts 398. In the illustrated example, the pivot axis of adjustment member 414 is coincident with axis 374 of crank system 328. As a result, movement of front end flexible end mounts 398 from the lowest position to the highest position results in an increase in the overall step height or distance with a majority of the increase occurring at the upper end of the range of motion. In other words, the upper end or highest vertical height attained by the footpads 326 during their motion will rise by an extent nearly equaling the total increase in step height distance. The lowest point to which the footpads 326 fall in only minimally lowered. By way of example, it the step height or range is increased by a distance X, the highest vertical point of foot pads 326 may increase by a distance ⅘ X which the lowest vertical height will only fall by a distance ⅕ X. As a result, linkage assemblies 320 may be supported at a lower elevation with a reduced risk of the linkage assemblies 320 or their footpads 326 bottoming out as a result of step height adjustment.

In other embodiments, adjustment member 414 and crank system 328 may pivot or rotate about different axes. For example, the axis of adjustment member 414 and crank system 328 may be offset such that changes in the step height or step range (the distance between the highest and lowest points in the path of foot pads 326) are equally distributed such that an increase or decrease in step height or range will result in the highest vertical point and the lowest vertical point of the path of pads 326 being raised and lowered by substantially equal amounts. In yet other embodiments, the axis of adjustment member 414 and crank system 328 may be offset such that changes in the step height or step range are largely achieved at the lower end of the range of motion, the lowermost elevation changing by a much larger extent as compared to the extent to which the uppermost elevation of foot pads 326 changes.

Although front end flexible element mounts 398 are illustrated as moving in unison, front end flexible element mounts 398 may be supported so as to be movable independent of one another to different locations—either by being rotated or by being translated. In yet other embodiments, step height adjustment member may move linearly through a slotted or sliding mechanism or the like. Overall, the location of step height adjustment mechanism 338 on front post 352 with vertical movement of front end flexible element mounts 398 provides a more compact and efficient design.

Actuator 416 and linkage 417 comprise a mechanism configured to rotate or move the adjustment member 414 between a plurality of different positions so as to position and retain front end flexible element mounts 398 at different positions with respect to frame 324, cranks 370 and flexible element crank guides 372. In one embodiment, actuator 416 comprises a motor configured to rotationally drive a threaded shaft or screw threadably engaging a nut or internally threaded member connected to member 414. Rotation of the threaded shaft or screw results in member 414 being raised and lowered and pivoting about axis 374. In other embodiments, actuator 416 and linkage 417 may comprise other means for raising and lowering member 414. For example, actuator 416 may alternatively comprise a hydraulic or pneumatic piston and cylinder assembly. In yet another embodiment, after 416 may comprise an electric solenoid. In still other embodiments, actuator 416 may comprise various gears or cam arrangements.

Although actuator 417 is illustrated as being attached to frame 324 rearward of post-352 and being further attached to member 414 rearwardly of the pivot axis of member 414, in other embodiments, actuator 417 may alternatively be attached to the member 414 forwardly of the pivot axis of member 414, on the same side of the pivot axis as mounts 398. In yet other embodiment, actuator 417 may be supported on the forward side of front post 352 or on another part of frame 324.

Figure 24A:
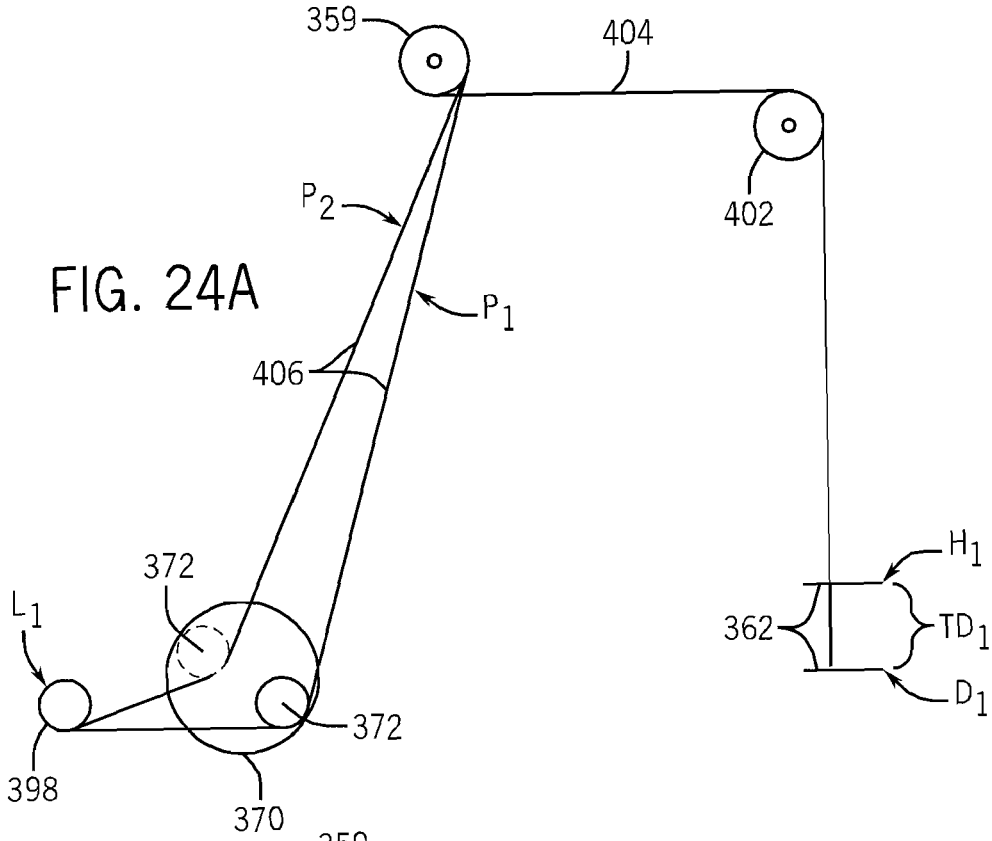
FIG. 24A is a diagram illustrating flexible elements of the exercise apparatus of FIG. 17 at one step height setting.
Figure 24B:
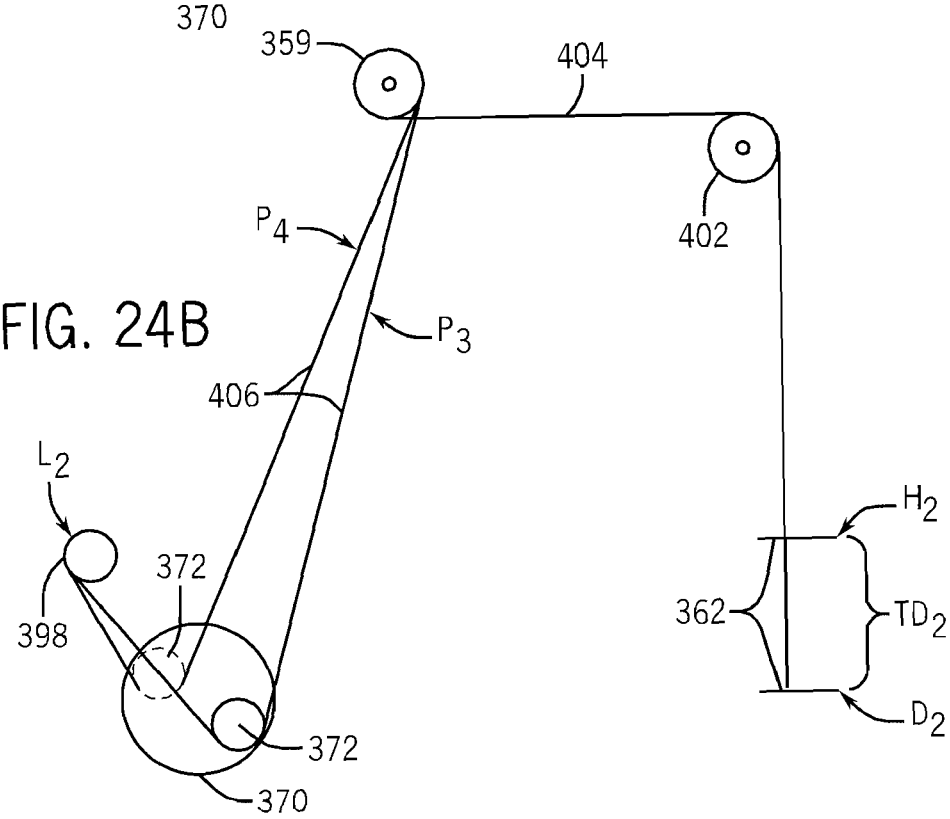
FIG. 24B is a diagram illustrating flexible elements of the exercise apparatus of FIG. 17 at another step height setting.

FIGS. 24A and 24B diagrammatically illustrate the adjustment of travel distance achieved by the repositioning of front end flexible elements mounts 398. Both figures present an approximate elevation view of select components of step height adjustment mechanism 338, crank system 328, coupling system 334 and linkage assemblies 326. As shown by FIGS. 24A and 24B, repositioning front end flexible element mount 398 varies the amount or extent by which the front flexible element 406 wraps about the associated flexible element crank guide 372. This change in the amount of wrap changes the travel distance or travel range of foot supports 362. In one embodiment, the maximum step height, maximum step depth or both maximum step height and depth of the path through which footpads 362 may be adjusted.

FIG. 24A illustrates the approximate orientation of components when adjustment member 414 is pivoted to position front end flexible elements mounts 398 at their lowest point, L1. The resulting step height is "Low Travel Distance", TD1, which is the difference in the location of one of foot pads 362 at point H1 and the location of the other foot pad 362 at point D1. FIG. 24B illustrates the approximate orientation of components when adjustment member 414 is pivoted to position front end flexible elements mounts 398 at their highest point, L2. The resulting step height is "High Travel Distance", TD2, which is the difference in the location of one of foot pads 362 at point H2 and the location of the other foot pad 362 at point D2.

As illustrated by FIG. 24A, when front end flexible element mount 398 is at the lowest position L1, the combination of front flexible element 406 and rear flexible element 404 on one side of exercise apparatus 320 extends along path P1 resulting in foot pad 362 location at position H1. The combination of front flexible element 406 and rear flexible element 407 on the opposing side of exercise apparatus 320 extends along path P2 resulting in foot pad 362 at position D1. The distance between the first foot pad 362 position H1 and the second foot pad 362 position D1 is TD1, "Low Travel Distance". TD1 represents the minimum step height.

As illustrated by FIG. 24B, when front end flexible element mount 398 is at the highest position L2, the combination of front flexible element 406 and rear flexible element 404 on one side of exercise apparatus 320 extends through path P3 resulting in foot pad 362 position at H2. The combination of front flexible element 406 and rear flexible element 404 on the opposing side of exercise apparatus 320 extends along path P4 resulting in foot pad 362 position D2. The distance between the first foot pad 362 position H2 and the second foot pad 362 position D2 is TD2, "High Travel Distance". TD2 represents the maximum step height.

During pivoting of adjustment member 414, the amount of wrap of front flexible elements 406 around flexible element crank guides 372 changes. As the vertical location of front end flexible element mounts 398 rises from L1 toward L2, the amount of wrap increases which, in turn, changes the path of front flexible elements 406.

Each front flexible element 406 interfaces with a corresponding rear flexible element 404 at a torque bar 359. Front flexible element 406R wraps around and attaches to the torque bar inboard flexible element mount 401R. Rear flexible element 404R wraps around and attaches to torque bar outboard flexible element mount 400R. Rotation of the torque bars 359 around cross-shaft 349 translate movement between front flexible element 406 and rear flexible element 404. The total path length of each combination of front flexible element 406 and rear flexible element 404 remains essentially unchanged. A change in the position of the front flexible element mount 398 will result in a corresponding change to the position of foot pad flexible element mount 412, which repositions foot pads 362.

Increasing the wrap angle of front flexible element 406 around flexible element crank guide 372 increases the mechanical advantage of the user on the crank. Conversely, decreasing the wrap angle reduces the mechanical advantage of the user on the crank. By adjusting the position of front end flexible element mount 398, the maximum height and/or the maximum depth to which foot pad 362 may be raised or lowered may be adjusted. Likewise, the total range or total travel distance through which foot pad 362 is moved may also be adjusted Adjustment member 414 can be pivoted to a continuum of different positions and may be retained in any one position along the continuum. In other embodiments, adjustment member 414 may alternatively rotate between a multitude of distinct discrete spaced positions at various predetermined angles about its pivot point. In such an alternative embodiment, notches, detents or other retention mechanism may be used to define the distinct spaced positions at which adjustment member 414 may be retained.

Actuator 416 comprises a mechanism configured to move adjustment member 414. In the example illustrated, actuator 416 comprises a powered actuator driven by electrical power. In one embodiment, actuator 416 comprises an electric powered motor configured to drive a worm or lead screw arrangement to generate linear translation so as to rotate adjustment member 414 about axis 374. In yet another embodiment, actuator 416 may comprise an electric motor, such as a stepper motor, servomotor and the like, directly connected to a shaft secured to adjustment member 414 along axis 374 or connected to a shaft secured to adjustment member 414 by speed reducing device or gear train to selectively rotate adjustment member 414. In still other embodiments, actuator 416 may comprise electric solenoid or a hydraulic or a pneumatic piston-cylinder assembly operably coupled to adjustment member 414 so as to rotate adjustment member 414.

According to one embodiment, powered actuator 416 repositions adjustment member 414 to adjust the step height in response to control signals from a controller 446 associated with display 342. In one embodiment, such adjustment may be in response to a person depressing a button, sliding a slider bar, actuating a switch, entering a voice command to voice recognition software through microphone or other input. In another embodiment, such adjustment may be in accordance with a pre-programmed or predetermined exercise routine stored in memory, wherein the step height is to be adjusted during an exercise routine. Because such adjustment is powered and does not require a person to detach or disassemble any portion of exercise apparatus 320, such adjustment may be made "on-the-fly" during exercise as foot pads 362 are moving along a path. In other words, an exercise routine or workout need not be interrupted.

In other embodiments, actuator 416 may alternatively comprise a non-powered actuator. For example, actually 416 may alternatively be configured to be manually powered, wherein force or motion applied by a person is mechanically transmitted to adjustment member 414 to reposition adjustment member 414. After adjustment, adjustment member 414 may be retained in place by one or more hooks, clamps, catches, detents or friction surfaces.

Although adjustment member 414 is illustrated as being rotated so as to reposition end mounts 398 and so as to adjust the step height of exercise apparatus 320, in other embodiments, the positioning of end mounts 398 may be adjusted in other fashions. For example, in another embodiment, end mounts 398 may alternatively be linearly movable or configured to slide or translate between different positions relative to frame 324 and relative to crank flexible element guides 372.

Horizontal resistance system 340 comprises a system configured to apply additional resistance to or against horizontal movement of foot support members 360 and footpads 362. FIGS. 21-23 illustrate horizontal resistance system 340 in more detail. FIG. 23 is a rear view of exercise apparatus 320 with parts removed to reveal a rear view of horizontal resistance system 340. In the example illustrated, horizontal resistance system 340 is attached to the rearward side of front post 352 in an essentially vertical arrangement such that portions of resistance system 340 rotate about one or more horizontal axes. Such arrangement provides a more compact and efficient design of exercise apparatus 320. In other embodiments, resistance system 340 may be attached to a different side of front post 352 or to another portion of frame 324.

Horizontal resistance system 340 connecting elements 428R, 428L (collectively referred to as connecting elements 428, upper element mounts 426R, 426L (collectively referred to as upper element mounts 426), lower element mounts 427R, 427L (collectively referred to as lower element mounts 427), resistance source 430 and rocker 424.

Connecting elements 428 comprise rigid linkages or rods. Each of connecting elements 428 has an upper end attached to one of upper element mounts 426 and a lower end attached to one of lower element mounts 427 eccentrically located on rocker 424. Element 428R is attached to mounts 426R and 427R. Element 428L is attached to mounts 426L and 427L. Upper element mounts 426 are attached to hubs 361 associated with linkage assemblies 326. Lower element mounts 427 are operably connected to rocker 424. In the example illustrated, mounts 426 and 427 comprise swivel, universal or pivot joints or the like. Linkage assemblies 326 rotate in opposite directions in response to the forces imposed by upon swing arms 327 and foot supports 360 by the person exercising. As one of linkage assemblies 326 rotates in a clockwise direction as viewed from the left side of exercise apparatus 320, the upper element mount 426 attached to that linkage assembly 326 correspondingly rotates. The rotation raises the vertical position of element mount 426 and creates upward force on and movement of the element 428 attached to the element mount 426. The upward movement of element 428 results in corresponding movement of lower element mount 427. The movement of lower element mount 427 creates movement of rocker 424, which is operably connected to resistance source 430. In other embodiments, mounts 426 may be secured to other portions of linkage assemblies 326.

Rocker 424 and belt 422 operably connect elements 428 to resistance source 430. Rocker 424 is rotationally driven upon movement of elements 428 against the resistance provided by resistance source 430.

Resistance source 430 comprises a mechanism configured to rotate against a selectively adjustable resistance. In one embodiment, resistance source 430 comprises a metal plate and one or more magnets forming an Eddy brake. In one embodiment, the one or more magnets comprise electromagnets, allowing the strength of the magnetic force to be selectively adjusted to control and vary the resistance applied against the rotation of hubs 361 of linkage assemblies 326. In another embodiment, resistance source 430 may comprise an electric generator. In still another embodiment, resistance source 430 may comprise two surfaces in frictional contact with one another so as to generate resistance against rotation of hubs 361. In another embodiment, air brakes may be utilized. In still other embodiments, other brakes or resistance mechanisms may be utilized. In one embodiment, the resistance applied by horizontal resistance source 430 may be selectively adjusted by a person using exercise apparatus 320. In one embodiment, the resistance may be adjusted in response to control signals generated by controller 446 associated with display 342 in response to input from a person exercising or in response to a stored exercise routine or workout. In still other embodiments, horizontal resistance system 340 may be omitted.

Display 342 comprises a mechanism facilitating interface between exercise apparatus 320 and a person exercising. As schematically showing FIG. 17, display 342 comprises inputs 440, outputs 442, communication interface 444 and controller 446 (each of which is schematically illustrated in FIG. 1). Inputs 140 comprise one or more mechanisms configured to facilitate entry of commands or information to exercise apparatus 320 from a person. In one embodiment, such inputs may comprise a touch screen, one or more push buttons, one or more slider bars, toggle switches, a microphone and voice recognition software and the like.

Outputs 442 comprise one or more devices configured to present information to a person. In one embodiment, outputs 442 may comprise a display screen, light emitting diodes, audible signal or sound generating devices and the like. Communication interface 444 comprises a mechanism facilitating communication between exercise apparatus 320 and external systems or devices such as a network, the Internet, or other exercise apparatus. Communication interface 444 may be configured to facilitate wired or wireless communication.

Controller 446 comprises one or more processing units configured to receive information or commands from inputs 444 or communication interface 444 as well as information or data from various sensors associated with exercise apparatus 320. Controller 146 further analyzes such information and generate control signals directing the display of information by display 142, the transmission of data or information or information requests via communication interface 144 and the operation of resistance sources 392, and 430 as well as actuator 416.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 444 may be embodied as part of one or more application-specific integrated circuits (ASICs). Unless otherwise specifically noted, the controller is not limited to any specific combination of hardware circuitry and software, nor to any particular source for the instructions executed by the processing unit.

During use of exercise apparatus 320, a person mounts platform 348 while generally grasping side arms 356. While continuing to grasp side arms 356, a person then mounts foot pads 362. The person exercising then inputs via inputs 440 desired workout or exercise routine or selects a pre-stored workout or exercise routine. In response to such inputs, controller 446 may generate control signals adjusting the amount of resistance applied by resistance sources 392 and 430. In addition, controller 446 may generate control signals causing powered actuator 416 to reposition front end flexible element mounts 398 to adjust the step height. During the exercise routine, person exercising may decide to adjust his or her stride or the path of his or her stride. This is achieved by the person simply applying a different force to footpad 362 and linkage assemblies 326. In addition, the person exercising may decide to increase or decrease the step height. To do this, person may simply enter a change using input 440, wherein controller 446 generates control signals causing actuator 416 to reposition adjustment member 414 to adjust the step height. As noted above, this adjustment may be made on the fly during exercise. In other embodiments, controller 446 may automatically adjust the resistance applied by one or both of resistance sources 392 and 430 as well as the step height controlled by step height adjustment mechanism 338 in accordance with stored exercise routine or workout. Such changes may be made based upon the lapse of time from the beginning of the workout, based upon time remaining in the workout, based upon sensed biometrics of the person exercising or based upon predetermined speed, force or motion path objectives or targets being met or not being met. Because exercise apparatus 320 enables the maximum step height or maximum step depth to be automatically adjusted by controller 446 or to be adjusted by a person during exercise, exercise apparatus 320 provides more flexible or versatile exercise options and a more enjoyable workout.

Figure 25:
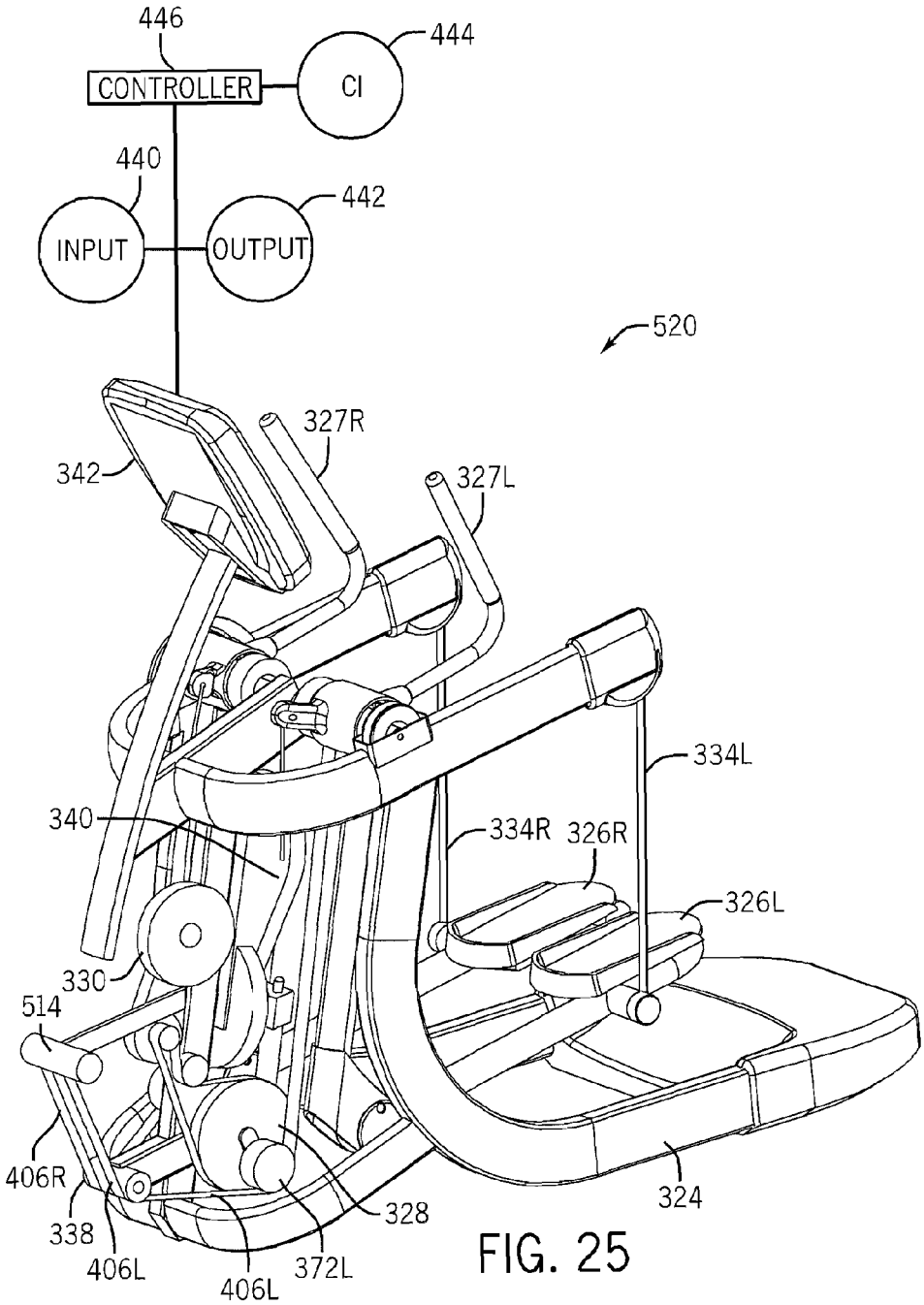
FIG. 25 is a top left perspective view of another embodiment of the exercise apparatus according to an example embodiment with portions schematically shown.
Figure 25A:
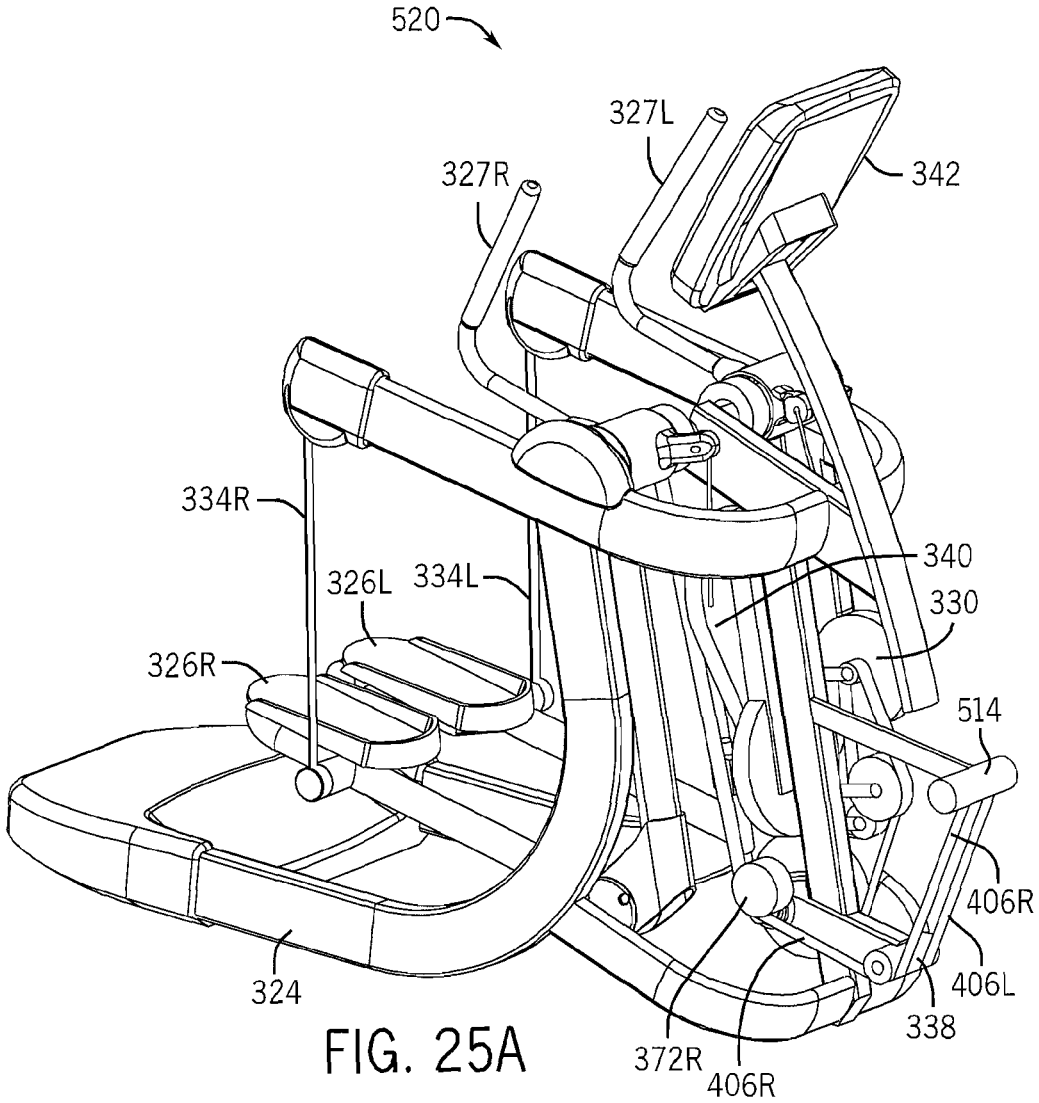
FIG. 25A is a top right perspective view of the exercise apparatus of FIG. 25.

FIGS. 25 and 25A illustrate exercise apparatus 520, another embodiment of exercise apparatus 320. Exercise apparatus 520 is identical to exercise apparatus 320 except that exercise apparatus 520 additionally includes fixed mount 514, wherein elements 406L and 406R wrap about adjustment member 414 and terminate at connections to fixed mount 514 which stationarily extends from frame 324. Movement of adjustment member 414 (as described above) causes flexible elements 406L and 406R to vary in the extent by which they wrap about guides 372L and 372R. As a result, step height or step range may be adjusted through movement of adjustment member 414. In one embodiment, flexible elements 406L and 406R secured to adjustment member 414 by welding, adhesive, fasteners and the like. In another embodiment, flexible elements merely contact, partially wrap about and slide against and relative to adjustment member 414 as adjustment member 414 moves from one position to another position to adjust step height or step range.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise apparatus comprising:

a frame having a base portion adapted to be supported by a floor;

a crank system having at least one crank pivotable about an axis;

a right linkage assembly comprising a right foot support and pivotally supported by the frame;

a left linkage assembly comprising a left foot support and pivotally supported by the frame;

first and second coupling systems each comprising a flexible element, wherein the first coupling system couples the at least one crank to the right foot support and the second coupling system couples the at least one crank to the left foot support; and a step height adjustment mechanism configured to allow a person to adjust a step height of a path through which the left and right foot supports move, the step height adjustment mechanism comprising:

a first flexible element crank guide carried by the at least one crank and a second flexible element crank guide carried by the at least one crank, wherein the first flexible element of the first coupling system partially wraps about the first flexible element crank guide and wherein the second flexible element of the second coupling system partially wraps about the second flexible element crank guide; and an adjustment mechanism operably coupled to the first flexible element and the second flexible element to adjust an extent to which the first flexible element and the second flexible element partially wrap about the first flexible element crank guide and the second flexible element crank guide, respectively.

2. The exercise apparatus of claim 1, wherein the at least one crank consists of a single crank and wherein the flexible element of each of the first and second coupling systems is coupled to the single crank.

3. The exercise apparatus of claim 2, wherein the single crank comprises:

a crank arm, wherein the first and second flexible element crank guides are carried by the crank arm.

4. The exercise apparatus of claim 1, wherein the flexible element of the first coupling system and the flexible element of the second coupling system have substantially horizontal parallel portions.

5. The exercise apparatus of claim 1 wherein the first coupling system and the second coupling system move the left foot support and the right foot support through a first selected one of a first plurality of different available paths that change between the first plurality of different available paths in response to force applied by a person to the left foot support and the right foot support.

6. The exercise apparatus of claim 1, wherein the at least one crank comprises:

a first crank moving the first flexible element of the first coupling system; and a second crank moving the second flexible element of the second coupling system.

7. The exercise apparatus of claim 6, wherein the first crank and the second crank pivot about a same axis.

8. The exercise apparatus of claim 6, wherein the first flexible element crank guide is carried by the first crank and wherein the second flexible element crank guide is carried by the second crank.

9. The exercise apparatus of claim 8, wherein the first crank and the second crank pivot about a same axis.

10. The exercise apparatus of claim 8, wherein the first flexible element crank guide and the second flexible element crank guide rotate 180 degrees out of phase relative to one another.

11. The exercise apparatus of claim 8, wherein the first flexible element crank guide and the second flexible element crank guide comprise first and second pulleys, respectively.

12. The exercise apparatus of claim 6 further comprising:

a rotational member, wherein the first crank and the second crank are operatively coupled to the rotational member; and a resistance source connected to the rotational member.

13. The exercise apparatus of claim 6, wherein the at least one crank is contained beneath a vertical midpoint of the exercise apparatus.

14. The exercise apparatus of claim 6 further comprising a rotatable torque bar, wherein the flexible element of the first coupling system comprises a first portion coupled between the right foot support and the torque bar and a second portion coupled between the torque bar and the at least one crank, wherein the first portion is connected to the torque bore so as to wind about the torque bar while the second portion unwinds from the torque bar.

15. The exercise apparatus of claim 1 further comprising a fixed mount attached to a terminal end of each of the first flexible element and the second flexible element.

16. The exercise apparatus of claim 1, wherein the first flexible element crank guide is carried by the at least one crank so as to rotate with the at least one crank about the axis and wherein the second flexible element crank guide is carried by the lease one crank so as to rotate with the lease one crank about the axis.

17. An exercise apparatus comprising:

a frame having a base portion of adapted to be supported by a floor;

a crank system having at least one crank pivotable about a substantially horizontal axis;

a right linkage assembly comprising a right foot support and pivotally supported by the frame;

a left linkage assembly comprising a left foot support and pivotally supported by the frame; and first and second coupling systems each comprising a flexible element, wherein the first coupling system couples the at least one crank to the right foot support and the second coupling system couples the at least one crank to the left foot support, wherein the flexible element of the first coupling system and the flexible element of the second coupling system have parallel portions extending in a single plane.

18. The exercise apparatus of claim 16 further comprising an adjustment member rotatable about the axis and providing a first flexible element end mount attached to an end portion of the flexible element of the first coupling system and a second flexible element end mount attached to an end portion of the flexible element of the second coupling system wherein the adjustment member is securable in different positions to retain the first flexible element end mount and the second flexible element end mount at a selected one of different positions.

19. The exercise apparatus of claim 17 wherein the first coupling system and the second coupling system move the left foot support and the right foot support through a first selected one of a first plurality of different available paths that change between the first plurality of different available paths in response to force applied by a person to the left foot support and the right foot support.

20. The exercise apparatus of claim 17 further comprising:

a step height adjustment mechanism configured to allow a person to adjust a step height of a path through which the left and right foot supports move, the step height adjustment mechanism comprising:

a first flexible element crank guide carried by the at least one crank so as to rotate with the at least one crank about the axis and a second flexible element crank guide carried by the at least one crank so as to rotate with the at least one crank about the axis, wherein the flexible element of the first coupling system partially wraps about the first flexible element crank guide and wherein the flexible element of the second coupling system partially wraps about the second flexible element crank guide; and an adjustment mechanism operably coupled to the flexible element of the first coupling system and the flexible element of the second coupling system to adjust an extent to which the flexible element of the first coupling system and the flexible element of the second coupling system partially wrap about the first flexible element crank guide and the second flexible element crank guide, respectively.

21. The exercise apparatus of claim 20, wherein the at least one crank comprises:

a first crank moving the flexible element of the first coupling system; and a second crank moving the flexible element of the second coupling system.

22. The exercise apparatus of claim 21, wherein the first crank and the second crank pivot about a same axis.

23. The exercise apparatus of claim 21, wherein the first flexible element crank guide and the second flexible element crank guide comprise first and second pulleys, respectively.

24. The exercise apparatus of claim 21 further comprising:

a rotational member, wherein the first crank and the second crank are operatively coupled to the rotational member; and a resistance source connected to the rotational member.

25. The exercise apparatus of claim 17, wherein the at least one crank is contained beneath a vertical midpoint of the exercise apparatus.

26. The exercise apparatus of claim 17 further comprising a rotatable torque bar, wherein the flexible element of the first coupling system comprises a first portion coupled between the right foot support and the torque bar and a second portion coupled between the torque bar and the at least one crank, wherein the first portion is connected to the torque bore so as to wind about the torque bar while the second portion unwinds from the torque bar.

27. The exercise apparatus of claim 17 further comprising a fixed mount attached to a terminal end of each of the flexible element of the first coupling system and the flexible element of the second coupling system.

28. The exercise apparatus of claim 17, wherein the first flexible element crank guide is carried by the at least one crank so as to rotate with the at least one crank about the axis and wherein the second flexible element crank guide is carried by the lease one crank so as to rotate with the at least one crank about the axis.

29. The exercise apparatus of claim 17, wherein the single plane is substantially horizontal.

* * * * *